United States Patent [19]

Bromley et al.

[11] Patent Number: 5,071,127

[45] Date of Patent: Dec. 10, 1991

[54] COIN BOWLING GAME

[75] Inventors: Lauren Bromley, Chicago; George A. Go.nez, Evanston, both of Ill.

[73] Assignee: Bromley Incorporated, Chicago, Ill.

[21] Appl. No.: 608,799

[22] Filed: Nov. 5, 1990

[51] Int. Cl.[5] ..... A63D 3/00; G07F 1/04

[52] U.S. Cl. ..... 273/85 A; 273/119 A; 273/129 W; 273/356; 273/85 G; 273/41; 273/126 A; 340/323 B; 194/344

[58] Field of Search ..... 194/344; 273/85 A, 118 R, 273/118 A, 119 R, 119A-125 A, 126 A, 127 R, 129 R, 129 W, 138 A, 85 G, 127 D, 37-39, 41, 351, 354, 355, 356, 357, 379, 390, 392, 371, 108; 340/323 B

[56] References Cited

U.S. PATENT DOCUMENTS

| | | | |
|---|---|---|---|
| 2,292,283 | 8/1942 | Muller | 273/122 A X |
| 2,609,203 | 9/1952 | Bula | 273/127 R X |
| 2,722,421 | 11/1955 | Nicolaus | 273/126 A |
| 2,722,422 | 11/1955 | Breitenstein | 273/126 A |
| 2,887,320 | 5/1959 | Gravelle et al. | 273/39 X |
| 2,914,327 | 11/1959 | Ginetta | 273/119 A X |
| 2,931,656 | 4/1960 | Hooker | 273/118 A |
| 2,966,561 | 12/1960 | Durant | 273/118 A X |
| 3,063,719 | 11/1962 | Rosenberger | 273/118 A X |
| 3,442,511 | 5/1969 | Payne | 273/127 R X |
| 3,703,288 | 11/1972 | Vogel et al. | 273/126 A X |
| 3,888,483 | 6/1975 | Adigkes et al. | 273/41 X |
| 4,008,893 | 2/1977 | Yoseloff | 273/85 R |
| 4,240,536 | 12/1980 | Noell, Jr. | 194/205 |
| 4,272,082 | 6/1981 | Shoemaker, Jr. | 273/356 |
| 4,283,049 | 8/1981 | Karlin et al. | 273/41 X |
| 4,303,248 | 12/1981 | Shoemaker, Jr. | 273/356 |
| 4,759,551 | 7/1988 | Crompton | 273/357 X |

FOREIGN PATENT DOCUMENTS

| | | | |
|---|---|---|---|
| 248730 | 12/1963 | Australia | 273/118 R |

*Primary Examiner*—Edward M. Coven
*Assistant Examiner*—Sebastiano Passaniti
*Attorney, Agent, or Firm*—Breneman & Georges

[57] ABSTRACT

A coin bowling amusement game is provided having target pins shaped in the form of bowling pins along with a pivotal coin chute, sweeper arm and display operated by a computer program in which coins are inserted into the coin chute and rolled down an enclosed platform to the target pins which, when struck, activates a display means for audibly or visually displaying a strike which then dispenses prizes and/or tickets redemmable for prizes or activates the sweeper arm after a predetermined number of misses are tallied by the computer controlled coin bowling game. The novel coin bowling game is designed to require or teach a considerable degree of skill in drawing the proper angle on target pins by requiring the operator to pivot the coin or token chute to a particular prize target pin having varying degrees of difficulty of striking alone or in combination with obstacle coins or obstacles disposed in the playing field that increase the amount of skill required to obtain prizes, tokens or tickets for successful coin bowling. A coin reject mechanism is provided to return defective or undesized coins along with solid state electronics, LED display, along with a microprocessor means for controlling the game.

20 Claims, 18 Drawing Sheets

Fig. 2
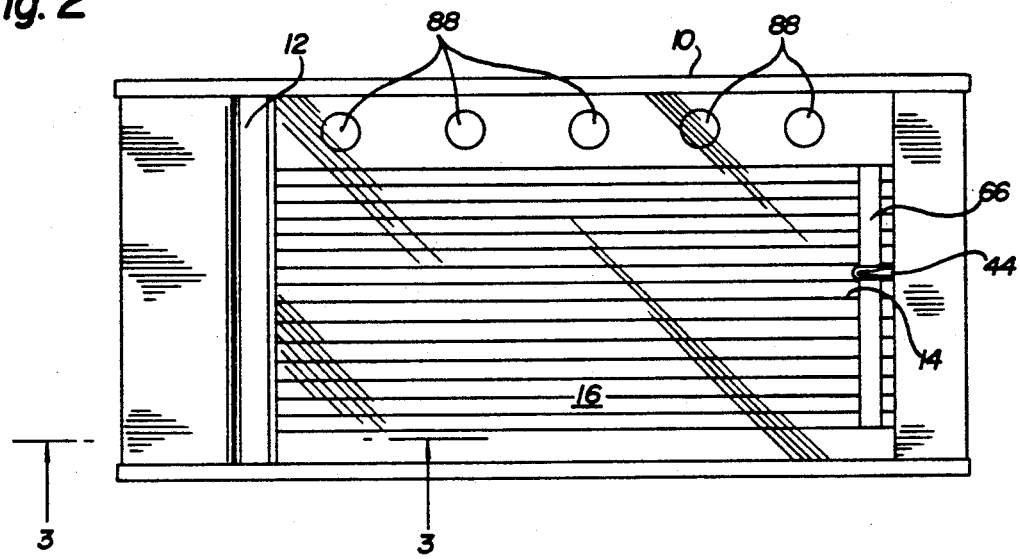
Fig. 4
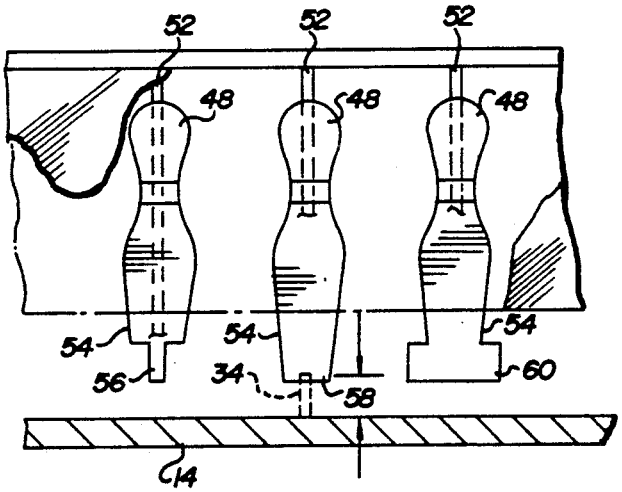
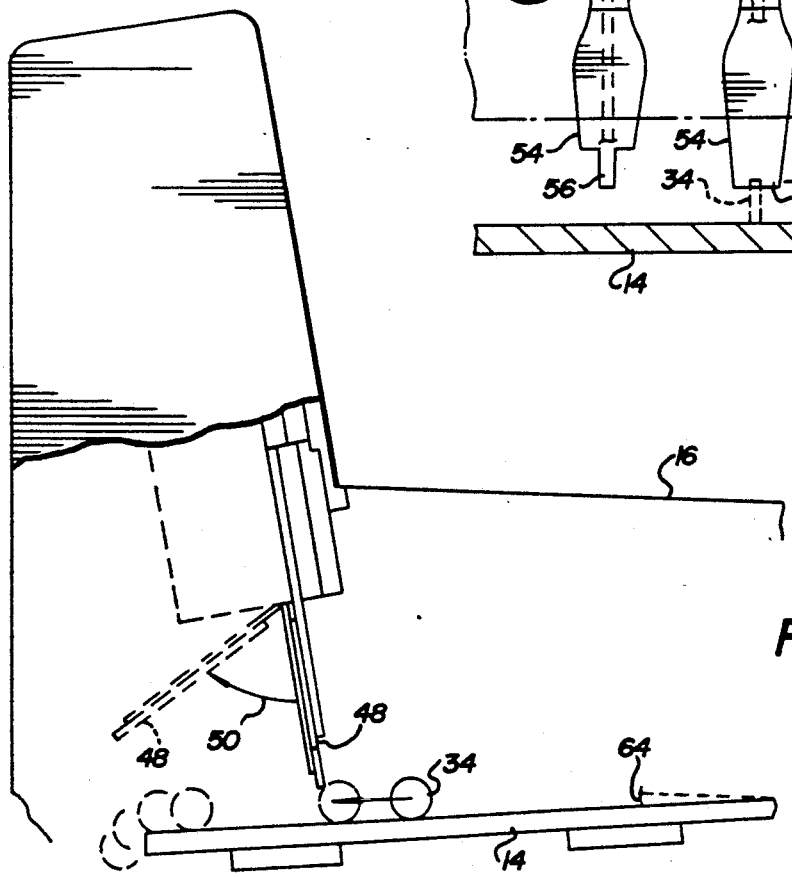
Fig. 3

| Fig. 10A | Fig. 10B |
|---|---|

| I.C. | PIN NUMBER +5 | GND |
|---|---|---|
| HCT273 | 20 | 10 |
| LS273 | 20 | 10 |
| LS00 | 14 | 7 |
| LS20 | 14 | 7 |
| LS390 | 16 | 8 |
| HC4020 | 16 | 8 |
| LS245 | 20 | 10 |
| LS161 | 16 | 8 |
| LS74 | 14 | 7 |
| LS244 | 20 | 10 |
| 4503 | 16 | 8 |
| LS139 | 16 | 8 |
| LS02 | 14 | 7 |
| LS32 | 14 | 7 |

NOTE:
-ALL CAPACITOR VALUES ARE IN MICROFARADS, UNLESS OTHERWISE SPECIFIED.
-ALL RESISTOR VALUES ARE IN OHMS, 1/4W, 5%, UNLESS OTHERWISE SPECIFIED.
-BYPASS CAPACITOR VALUE IS 0.1mfd.

COIN BOWLING GAME

BACKGROUND OF THE INVENTION

1. Field of the Invention

The present invention pertains to amusement games and devices such as found in amusement parks and arcades in which one or more players apply or attempt to sharpen their skills and in return receive reward games or prizes from arcade game machines. More particularly the invention pertains to a coin or token bowling device in which the operator aims a pivotal coin or token chute at one of the targets in the form of bowling pins disposed at the other end of a substantially flat playing surface for the purpose of depositing the coin down through the chute on its edge onto the substantially flat playing surface to the bowling pin target to obtain prizes or tokens related to the value of the selected target and the skill of the player in aiming the pivotal chute at the target.

The pivotal coin chute together with a slightly inclined substantially flat playing surface provides sufficient inertia for the coin to strike and activate a particular target and register a prize as long as the chute is properly angularly aligned by the player at a particular target. A coin reject device is provided for improperly sized coins or tokens or for defective coins or tokens that do not have a sufficiently cylindrical uniform edge such as would impede its progress to the token target. The amusement game of the invention further includes a computer program, associated microprocessor and electronics for activating an LED light display and speaker for providing visual and audible means for signalling a successful strike of coins or tokens properly directed at bowling pin targets. The amusement game of the invention further includes a sweeper arm, computer program and associated electronics and electrical motor for activating the sweeper arm for removing fallen or obstacle coins or tokens which may have fallen due to being improperly aimed at the sides of the enclosed substantially flat playing surface or resulting from jarring of the amusement device to change direction of the rolling coin or token or contact with obstacle coins or tokens left in the field of play. The computer program, microprocessor and associated electronics are designed to challenge and increase the level of skill of the player. The amusement game as a result of its solid state design, computer program, pivotal coin chute and sweeper arm activated upon pre-programmed conditions, alone or in combination with player defined conditions provide a challenging game of skill with variation and flexibility limited only by the imagination of the computer programmer.

2. Description Of The Prior Art

The prior art amusement devices include a wide variety of games which depend upon various permutations of skill and chance to win prizes. There are in addition numerous types of bowling games available which depend more on skill than on chance to win prizes or to obtain a successful score. There are in addition electronic games which utilize logic circuits and microcontrollers with associated signal processing circuitry to sense output and keep score which include LED devices. The prior art therefore includes a wide variety of relevant amusement devices which, while piecemeal, bear some similarity to the invention are completely different in operation, object and combination of components. This prior art appears to be located in three different categories, namely the Penny Falls prior art, the bowling games and the electronic type bowling games.

The Penny Falls prior art is described in Noell, Jr. U.S. Pat. No. 4,240,536 which employs a pivotal coin chute. Noell, Jr. U.S. Pat. No. 4,240,536 describes "Crompton's Cake Walk" and the "Crompton's Penny Falls" prior art devices in which a reciprocating bar reciprocates over the platform surface to advance coins, tokens or prizes or a combination thereof toward a prize collection box for advancing coins, tokens or prizes toward the player. The amusement device of Noell, Jr. U.S. Pat. No. 4,240,536 introduces a pivotable coin chute which may be pivoted angularly with respect to the platform to introduce coins to the platform at an angle other than 180 degrees with respect to the platform.

The pivotal coin chute of Noell, Jr. U.S. Pat. No. 4,240,536 while designed to introduce the coin onto the platform on the edge does so merely for purposes of convenience since the rolling coin once introduced falls on its side as soon as possible after introduction to the platform in order to have the coins displace and advance previously fallen coins or prizes by the action of the constantly reciprocating bulldozer blade toward the player. Noell, Jr. U.S. Pat. No. 4,240,536 furthermore does not utilize a microprocessor, computer program or activate the bulldozer blade upon predetermined conditions in the computer program or provide targets that are connected to the microprocessor and associated display.

As a result Noell, Jr. U.S. Pat. No. 4,240,536 while relevant to the pivotal coin chute of the invention does not have as an object or purpose the introduction of the coin through a pivotal chute for aiming a rolling coin or token at targets disposed at the other end of a platform to approximate a bowling game of skill. Even though a skill may be employed in the operation of such prior art amusement devices the constant reciprocation of the reciprocating bar in combination with the lack of specific targets or bowling pins together with a microprocessor and computer program does not provide such a challenging game or one that can be modified by changes in the computer program.

Bowling game prior art relevant to the invention includes such bowling games as Vogel, et al. U.S. Pat. No. 3,703,288, Karlin, et al. U.S. Pat. No. 4,283,049, Durant U.S. Pat. No. 2,966,561, Rosenberger U.S. Pat. No. 3,063,719 and Gravelle, et al. U.S. Pat. No. 2,887,320. These prior art amusement devices pertain to simulated bowling games utilizing the traditional ten pin triangular bowling ball target format in combination with associated electronic switches and circuits to simulate a bowling ball game. Most of these prior art devices employ either a ball or a flat sliding puck for sliding across the playing board platform to strike and simulate the action of a bowling ball game.

Generally such prior art amusement games using a ball or sliding puck simulate a ten pin bowling game requiring the hitting of all ten pins to result in a strike and do not utilize a single target, computer program or a pivotable coin chute for angularly introducing and maintaining the rolling of the coin on its edge to strike a particular prize pin. Some of these references do employ various forms of circuitry to generate noise stimulation and devices to prevent actuation of the circuitry when the platform is subject to shock o other types of jarring.

The Gravelle, et al. circle bowling game (U.S. Pat. No. 2,887,320) unlike the prior art bowling games employs a rolling disc introduced into a starting gate to roll in an arcuate path to contact an indicator means which measures and govern. the path of the rolling disc as it continues on its circular path prior to striking a plurality of pins at the end of the circular path. the circular bowling game of Gravelle, et al. U.S. Pat. No. 2,887,320 rely more upon luck than skill since the circular path and the number of pins activated by the disc after passing through the indication means which both governs and indicates the path of the rolling disc thereby removing a certain amount of skill from the game by both measuring and directing the circular path before the rolling disc strikes the standard simulated ten pin arrangement in order to score in the operation of the game. Gravelle, et al. U.S. Pat. No. 2,887,320 furthermore does not include a microprocessor and associated computer program, sweeper arm, pivotal inclined coin chute and other components which assist in the operation of the amusement game but also reward and increase the aspects of skill and adaptability inherent in the game.

The prior art electronic type games such as represented by Chang, et al. U.S. Pat. No. 4,369,971 and deOrbegoso, et al. U.S. Pat. No. 4,893,821 employ micro-controllers and micropocessors. The electronic simulated bowling game as represented by Chang, et al. U.S. Pat. No. 4,369,971 employs a digital display, logic circuitry and a computer program but does not provide a game that is in any other way similar to the game of the invention which utilizes a pivotal coin chute and the edge of a rolling coin to strike individual targets having different point values for the release of prizes. Similarly deOrbegoso, et al. U.S. Pat. No. 4,893,821 provides a display, logic and micro-controllers but like Chang, et al. 4,369,971 does not provide a simulated bowling game having a pivotable coin chute in which a coin is introduced to the playing platform and rolled on its edge to a particular target having varying point values where the coin chute can be pivotally rotated and aimed at a particular target pin so that the coin travels in a straight line path to a particular target bowling pin for releasing prizes or other tokens.

It will be appreciated the prior art does not include a coin bowling game of skill similar to the invention in which a coin or token is pivotally directed onto a substantially flat platform for rolling across the length of the platform to be aimed by the player at one of a series of target prize pins of his choice having varying degrees of skill and prize levels associated with the pin or target which includes a display, microprocessor and computer program for controlling the game and activation of a sweeper arm for removing or leaving fallen tokens or coins to increase the level of skill or difficultly in attaining prizes or tokens or other types of rewards. It will be further appreciated the control forces required to utilize a rolling coin to strike a particular target in relation to the length of the playing platform and angle of the chute together with the activation of the target pins by the rolling coin requires a sensitive and responsive mechanism to result in the awarding of prizes, tokens, tickets or other types of rewards for playing the game and increasing the level of skill of the player. Accordingly the invention provides a new and improved microprocessor game and associated computer program for fostering a higher degree of skill in obtaining prizes while providing electro-mechanical features for accurately controlling the game and program controlled means for removing fallen coins or tokens from the playing surface at predetermined intervals.

SUMMARY OF THE INVENTION

The invention pertains to a new amusement game controlled by a microprocessor having a substantially flat playing surface with a player end and a target end having at least one target for a rolling coin or token introduced onto the substantially flat playing surface through a pivotal coin chute and a sweeper arm for clearing the playing surface and means for signalling a successful strike of the coin or token against a particular target with associated circuitry for activating light and sound displays. The substantially flat playing surface is housed in a housing having a transparent cover for covering the playing surface, mounting the display, a speaker and the pivotable coin chute.

The pivotable coin chute alone or together with an incline of the playing platform is designed to allow the player to aim and introduce rolling coins on their edge for rolling them across the playing surface to one of a plurality of targets or pins. The pins are arranged in a linear row across the target end of the playing platform and are designed to include bases of varying widths to correspond to the difficulty of the prize or reward level in relation to the ability to pivot and roll a coin on its edge across the length of the playing platform to strike the bottom half of the pin target to activate the award of a prize.

The sweeper arm is disposed intermediate the ends of the playing surface or enclosed platform and is activated at predetermined times by the programmable software of the microprocessor to remove any fallen coins or tokens in the playing field due to jarring or tilting of the machine as the coin is rolling to the target or as a result of the coin bouncing off or striking a side wall of the playing platform. The sweeper arm may be activated after a predetermined number of coins have been introduced into the game that were not registered as hitting a target pin or otherwise accounted for by a totalizer. Alternatively the sweeper arm may be activated by pressing an optional clear button disposed in the housing to clear the playing field before introducing a coin or token onto the playing surface of the amusement game.

A token, ticket or other prize or redemption reward system means may be associated with the novel bowling amusement game to award prizes when a particular prize pin is struck by the player. The speaker or other audible or visual display indicator may also be included to indicate the striking of a prize pin alone or together with a visual display of the lights in the display to indicate a successful strike. An optional low prize indicator may be provided in the housing which alone or together with the audible indicator may be utilized to warn attendants or players of a low prize condition of the amusement game.

The tapered funnel shaped coin chute is pivotally disposed in the housing and maintained at a sufficient angle of incline with respect to the playing surface so as to impart sufficient velocity to a coin deposited in the slot to strike targets disposed at the other end of the playing surface after the coin has proceeded past a coin accept and reject mechanism for returning or removing improperly sized coins or tokens and removing dented or misshapen tokens or coins to the player. The coin after leaving the coin accept and reject mechanism in the coin chute proceeds with sufficient velocity to roll down the incline of the chute alone or together with an inclined playing surface to contact the playing surface at a sufficient velocity and roll on its edge across the length of the playing platform to the target area and hit one of the targets to the end of the playing platform and proceed to the coin collection source disposed behind and below the target end of the substantially flat playing surface.

The pivotal coin chute is first aimed by the player by pivoting and aligning the outlet of the coin chute with one of the targets and the target end of the game having values commensurate with the difficulty of striking the target with the rolling coin which, when struck, advance tickets or other types of rewards by activating switches connected to the microprocessor and associated circuitry of the novel coin bowling game. The sweeper arm is connected to the microprocessor through associated circuitry and computer program which may be programmed to be activated after a predetermined number of coins are inserted in the coin chute which do not strike targets or may be modified through modifications in the program to activate the sweeper bar after the insertion of each coin or token to modify the complexity of the game.

In one typical computer program the game is activated by the insertion of a coin which sets the timer and activates the coin accept and reject mechanism to determine whether the coin is valid or invalid. If the coin is invalid the coin is returned to the player. Once a valid coin is inserted and accepted by the coin accept and reject mechanism and the chute has been pivoted in alignment with one of the targets the coin proceeds down the funnel shaped chute and activates a switch which turns on game bowling sounds as the coin rolls toward the target. The target pin when hit activates the switch attached to the target and associated circuitry to the microprocessor to activate the speaker to play the "pin hit" sounds and run the game lights and calculate the number of tickets won. The microprocessor thereafter activates a reward ticket dispenser mechanism to dispense tickets, tokens, toys or other prizes from the novel computer activated game. In the event none of the target pins are hit the microprocessor determines whether additional coins have been inserted in the coin bowling game and, if not, the game is reset.

In the event additional coins have been added, the coin accept and reject mechanism determines whether the coin is valid or invalid. In the event further valid coins are inserted the microprocessor repeats the activation of the game bowling sound by restarting the program and repeating the award of prizes if the target pins are hit. On the other hand if additional coins have not been inserted the microprocessor may be utilized to activate the sweeper arm if there have been a predetermined number of coins that have been inserted without striking a target to remove any fallen coins from the playing field. In addition an optional tilt mechanism may be added to actuate the sweeper arm when the machine is bumped or jarred during play to remove coins in play that have not struck a target pin and which might have fallen in the field of play. These and other modifications may be made to the software necessary for the activation of the sweeper arm and the operation of the game to change the complexity and skill required to play the game including the provision for multiple players utilizing different colored coins or tokens.

The description of the game, in conjunction with the microprocessor, associated circuitry LED lights, display, target pins and pivotal coin chute mechanism will be described in greater detail in the drawings together with the associated Appendix Item and detailed description of the invention. The objects, features and advantages of the invention will become apparent by reference to the specification taken in conjunction with the drawings and the description of the preferred embodiment of the invention.

DESCRIPTION OF THE DRAWINGS

Other advantages of the invention will become apparent to those skilled in the art from the following detailed description of the invention in conjunction with the accompanying drawings and Appendix Item in which:

FIG. 2 is a top plan view of the microprocessor controlled coin bowling game of FIG. 1;

FIG. 3 is a side elevational view partly in section taken along the lines 3—3 of FIG. 2;

FIG. 4 is an elevational view partly in section illustrating a portion of the target pins of the microprocessor controlled coin bowling game of the invention;

FIG. 12 is a circuit diagram of the microprocessor board schematics of the microprocessor controlled coin bowling game of the invention.

DESCRIPTION OF THE APPENDIX ITEM

Appendix Item 1, is a computer printout of the computer program of the microprocessor controlled amusement device in accordance with the preferred embodiment of the invention.

DETAILED DESCRIPTION OF THE INVENTION

Figure 1:
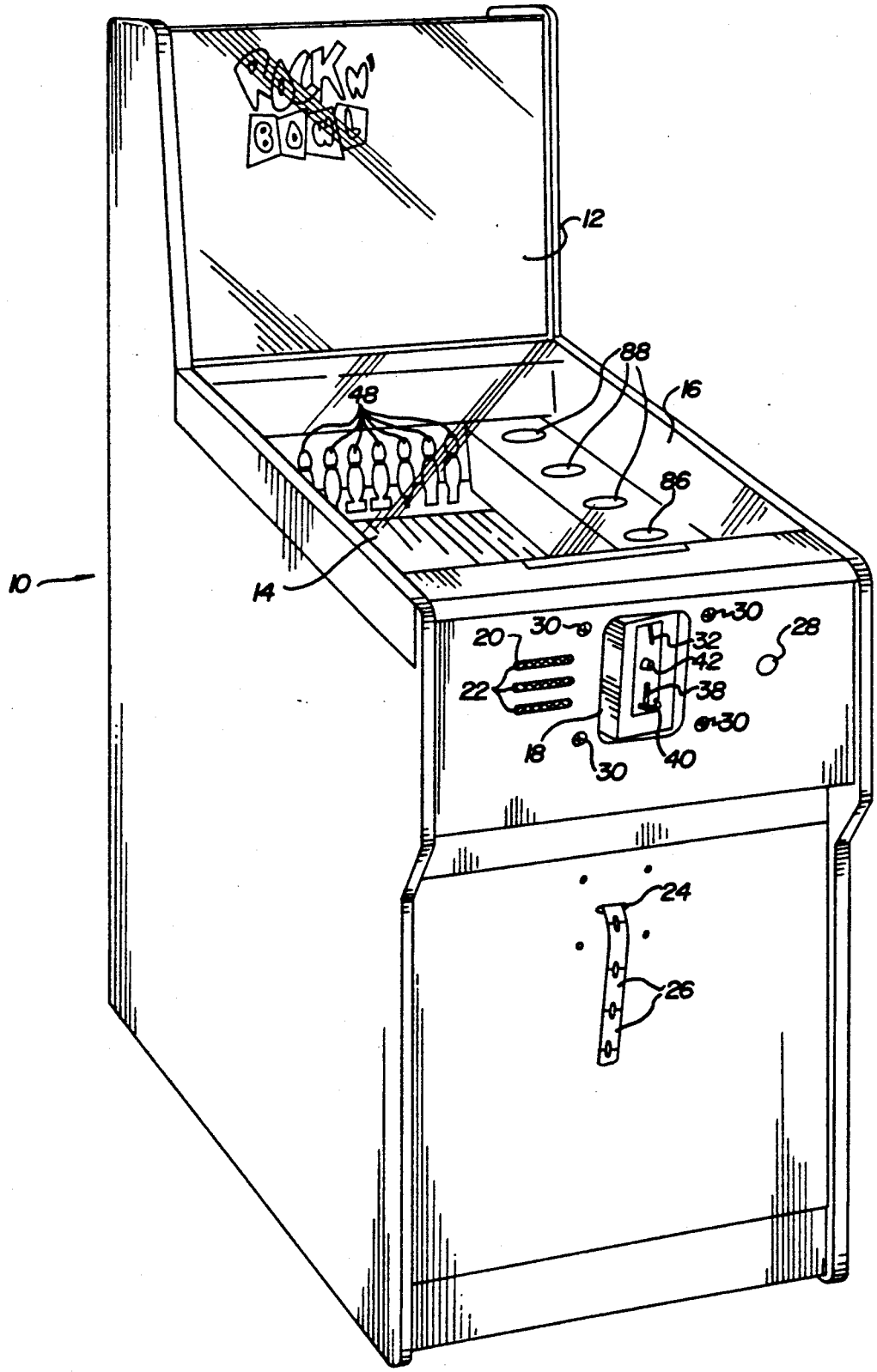
FIG. 1 is a perspective view of the microprocessor controlled coin bowling game of the invention.

Referring now to FIG. 1, a new microprocessor controlled game is illustrated having a generally rectangular shaped housing 10 including a screen or display 12 such as may be obtained from Churchill Cabinet having a plurality of LED or light displays (not shown) disposed in the display and a substantially flat playing surface 14 covered with a transparent cover 16 that may be composed of glass or plastic. The rectangular shaped housing 10 includes a pivotal coin chute 18 and a speaker 20 communicating through housing 10 through slots The housing 10 includes a toy, prize or other reward chute or slot 24 which for purposes of illustration is shown awarding a series of prize tickets 26. A standard prize ticket dispenser as found in arcade games such as is sold by Deltronics may be utilized. A low prize indicator light 28 is also provided in housing 10 to indicate to both the operator and arcade attendant of a low prize or token condition of the microprocessor controlled coin bowling game to indicate the need for servicing or replenishing the device with tokens prizes or tickets.

Figure 5:
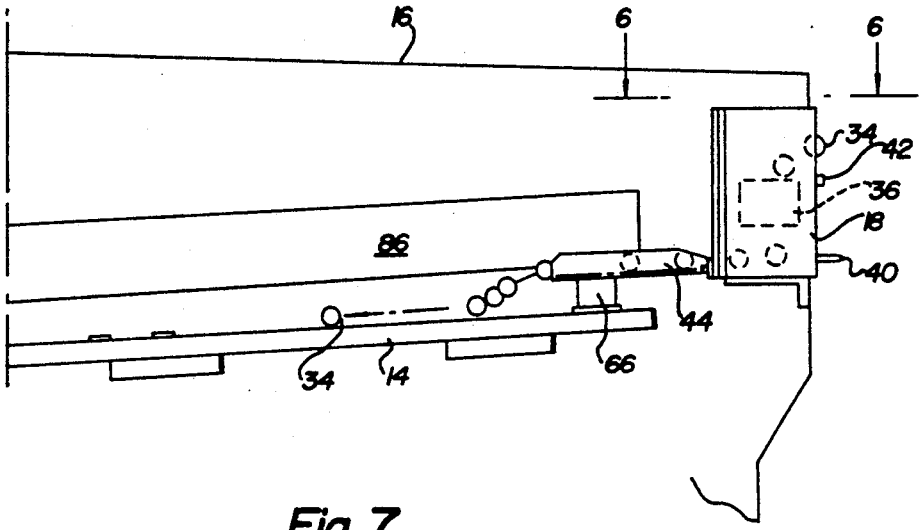
FIG. 5 is a side elevational view partly in section illustrating the pivotal coin chute and coin accept and reject device of the microprocessor controlled coin bowling game of the invention
Figure 7:
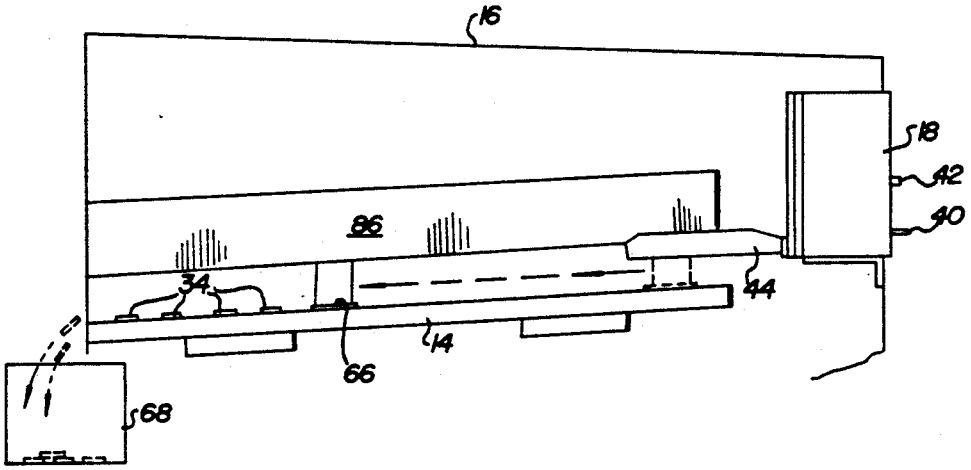
FIG. 7 is a side elevational view illustrating the operation of the sweeper arm of the microprocessor controlled coin bowling game of the invention.
Figure 6:
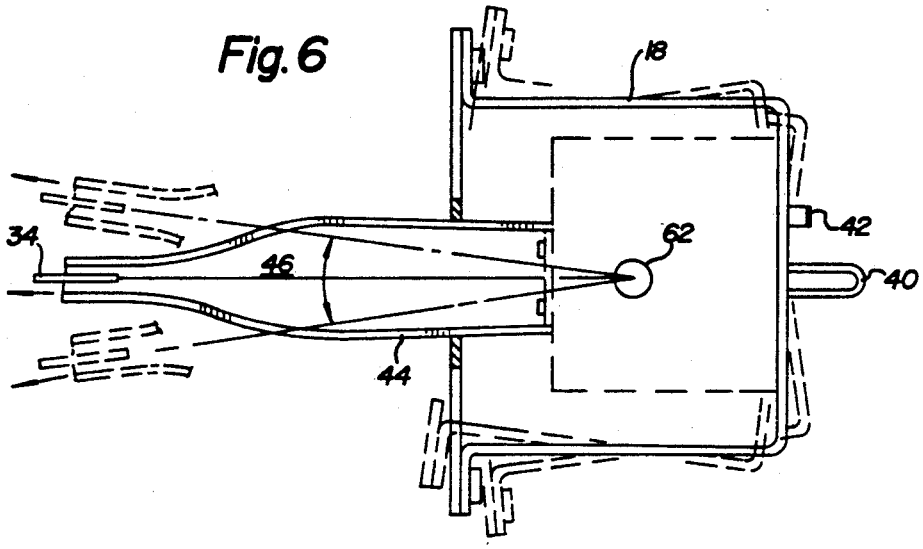
FIG. 6 is a view taken along the lines 6—6 of FIG. 5 of the coin accept and reject device in the pivotal chute illustrating in phantom the pivotal movement of the pivotal coin chute of the microprocessor controlled coin bowling game of the invention.
Figure 8:
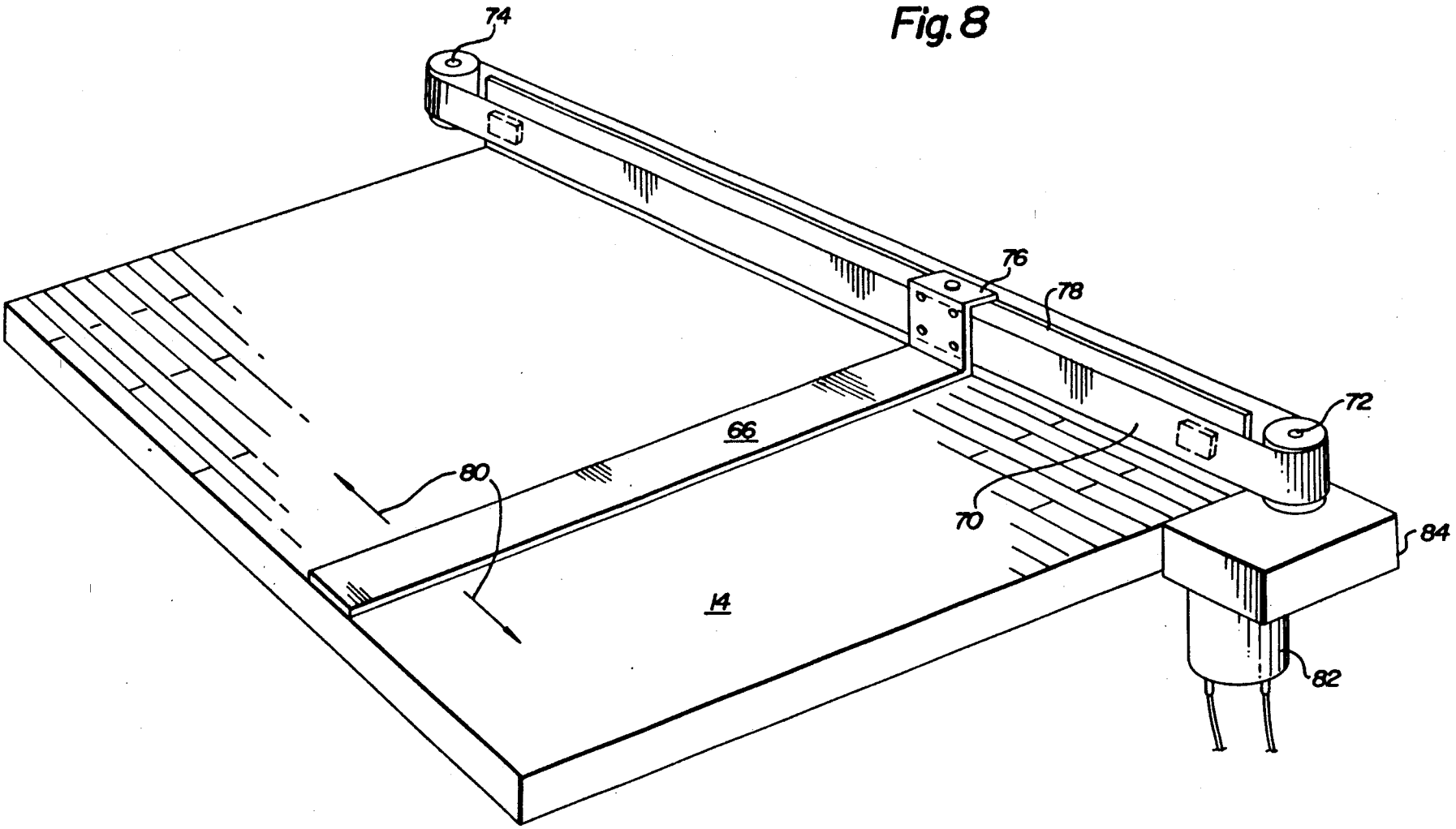
FIG. 8 is a perspective view of the sweeper arm of the microprocessor controlled coin bowling game of the invention.

With reference now to FIGS. 1 to 8 the mechanical and electro-mechanical elements are illustrated in greater detail in which the pivotal coin chute B FIGS. 1 to 5, 6 and 7 is pivotally mounted in housing 10 by means of a plurality of fasteners 30. Pivotal coin chute 18 includes a coin slot 32 for inserting a token or coin 34 which travel to a coin accept and reject mechanism 36 (FIG. 5). The coin accept and reject mechanism 36 is connected by circuitry to a microprocessor which starts the game if the coin is accepted or directs coin 34 to the coin return slot 38 with a coin return guard 40 for the return of improper, dented or otherwise misshapen or defective coins. To further assist in the return of such defective coins, a coin return button 42 is provided in association with the coin accept and reject mechanism 36 such as may be obtained from Coin Control, Inc. to return defective or coins of improper size.

Coins accepted by the coin accept and reject mechanism 36 are directed to a funnel shaped coin guidance chute 44 such as may be obtained from Ricar Industries for depositing the coin onto the playing surface 14 as illustrated in FIG. 5. A coin 34 accepted by the coin accept and reject mechanism 36 are directed on their edge onto the playing surface 14 by the funnel shaped trough 46 of the coin guidance chute 44 to propel the coin 34 on its edge with sufficient velocity toward a plurality of target pins 48 disposed at the target end of playing surface 14 across from the coin guidance chute 44.

Figures 10, 10A:
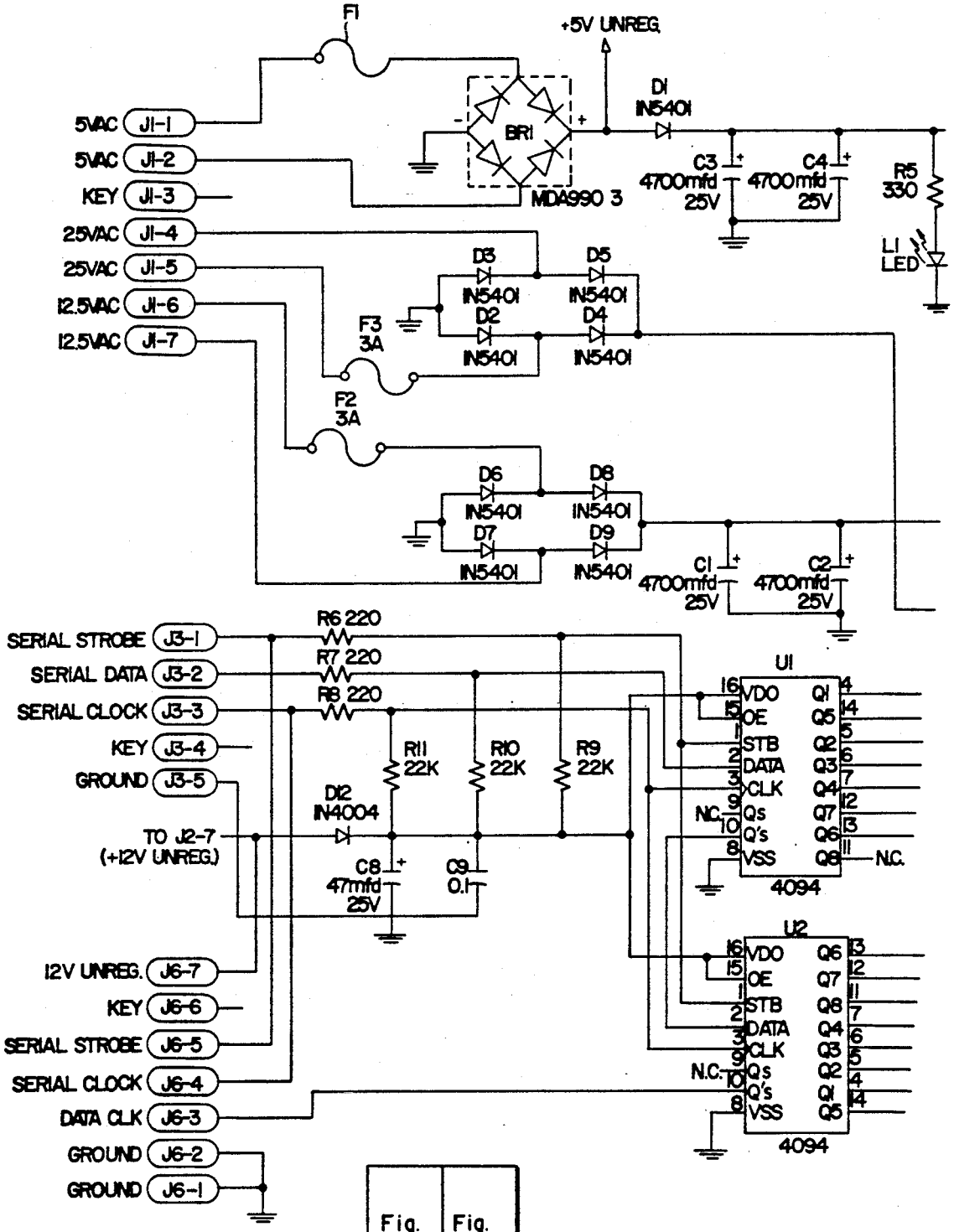
FIG. 10 consisting of FIG. 10A
Figure 10B:
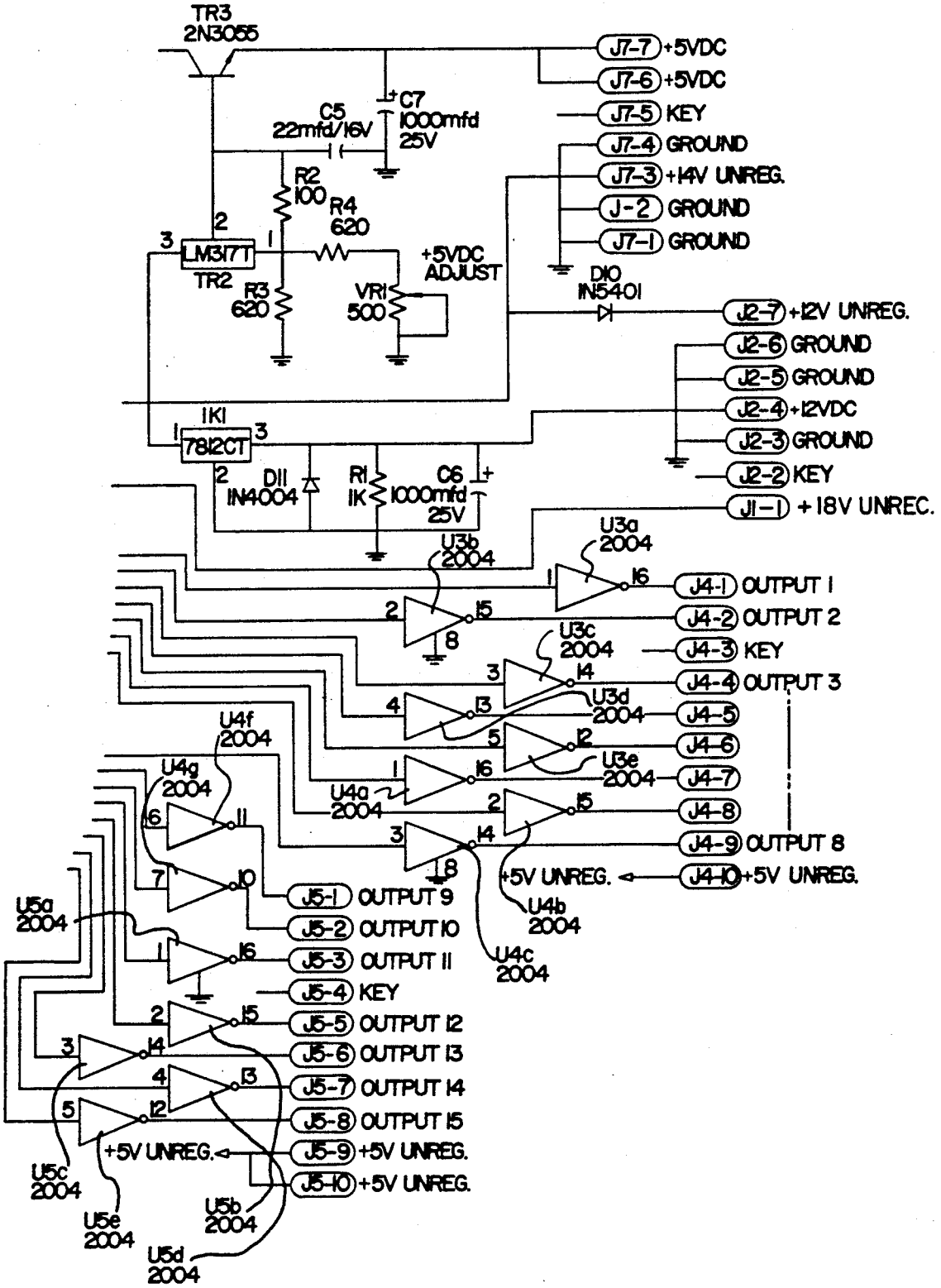
FIG. 10B is a circuit diagram illustrating the power supply and driver board schematics for the microprocessor controlled coin bowling game of the invention.
Figures 11, 11A:
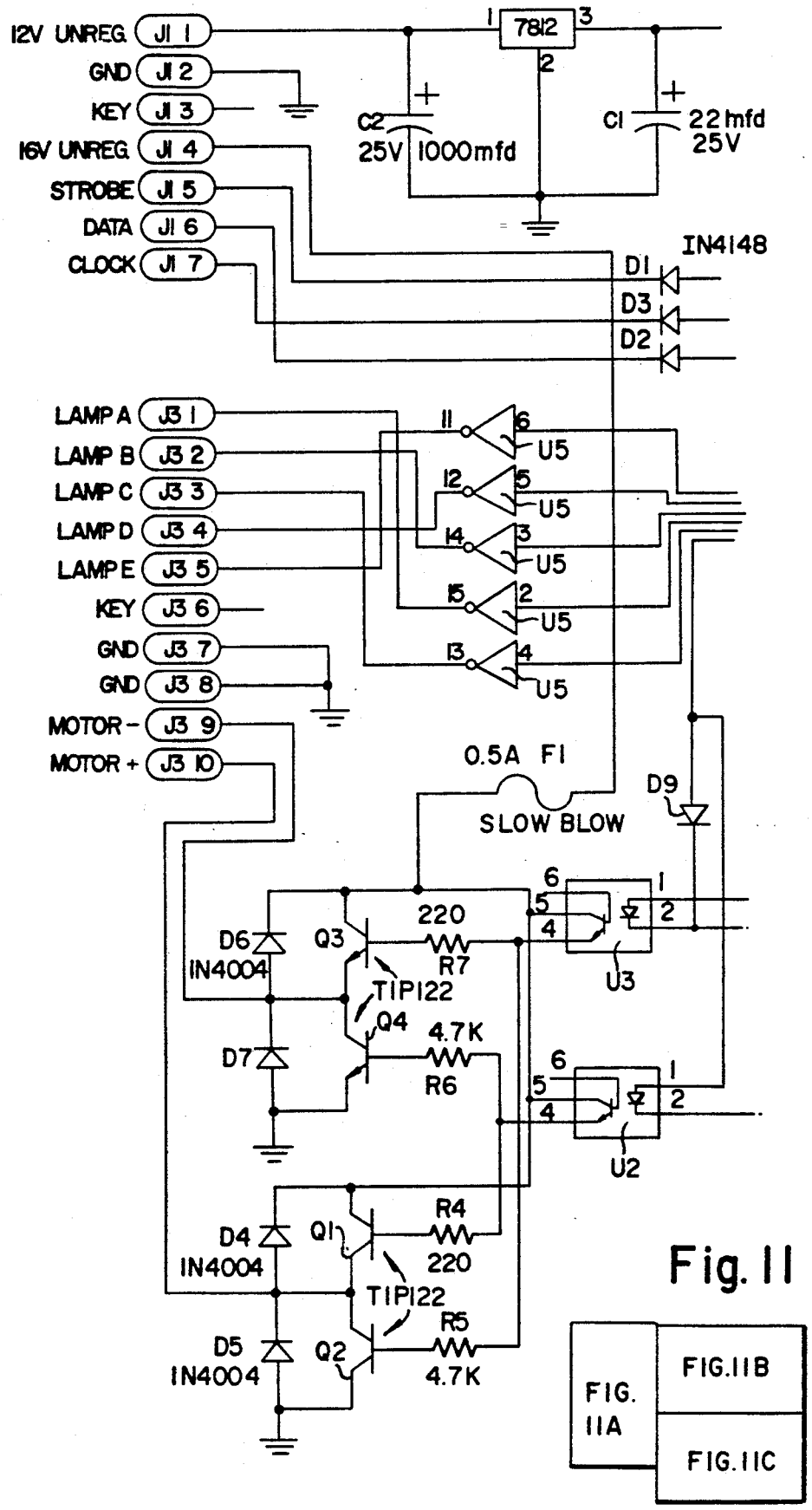
FIG. 11 consisting of FIG. 11A, FIG. 11B
Figure 11B:
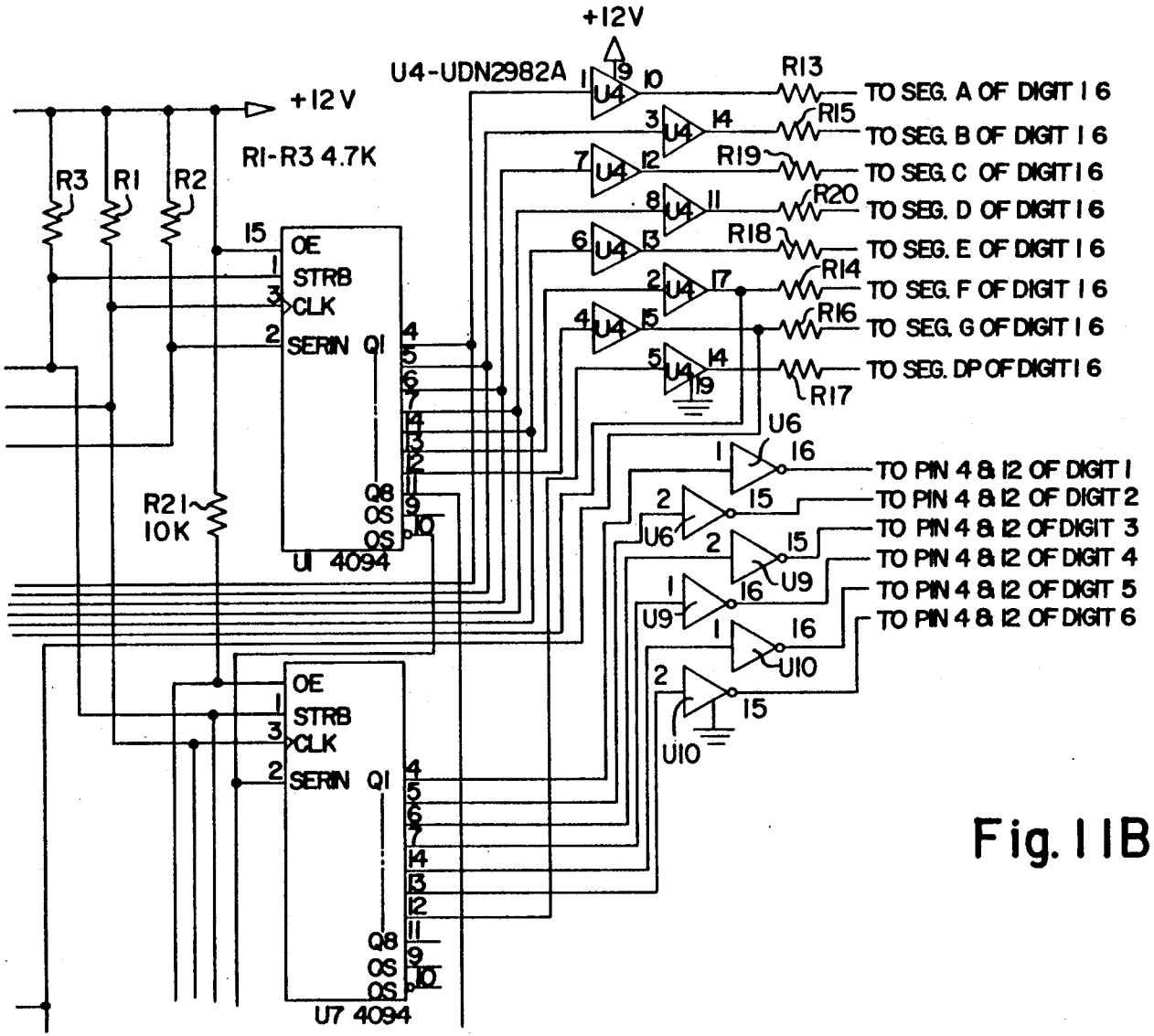
FIG. 11C is a circuit diagram of the display and driver board schematics for the microprocessor controlled coin bowling game of the invention.
Figure 11C:
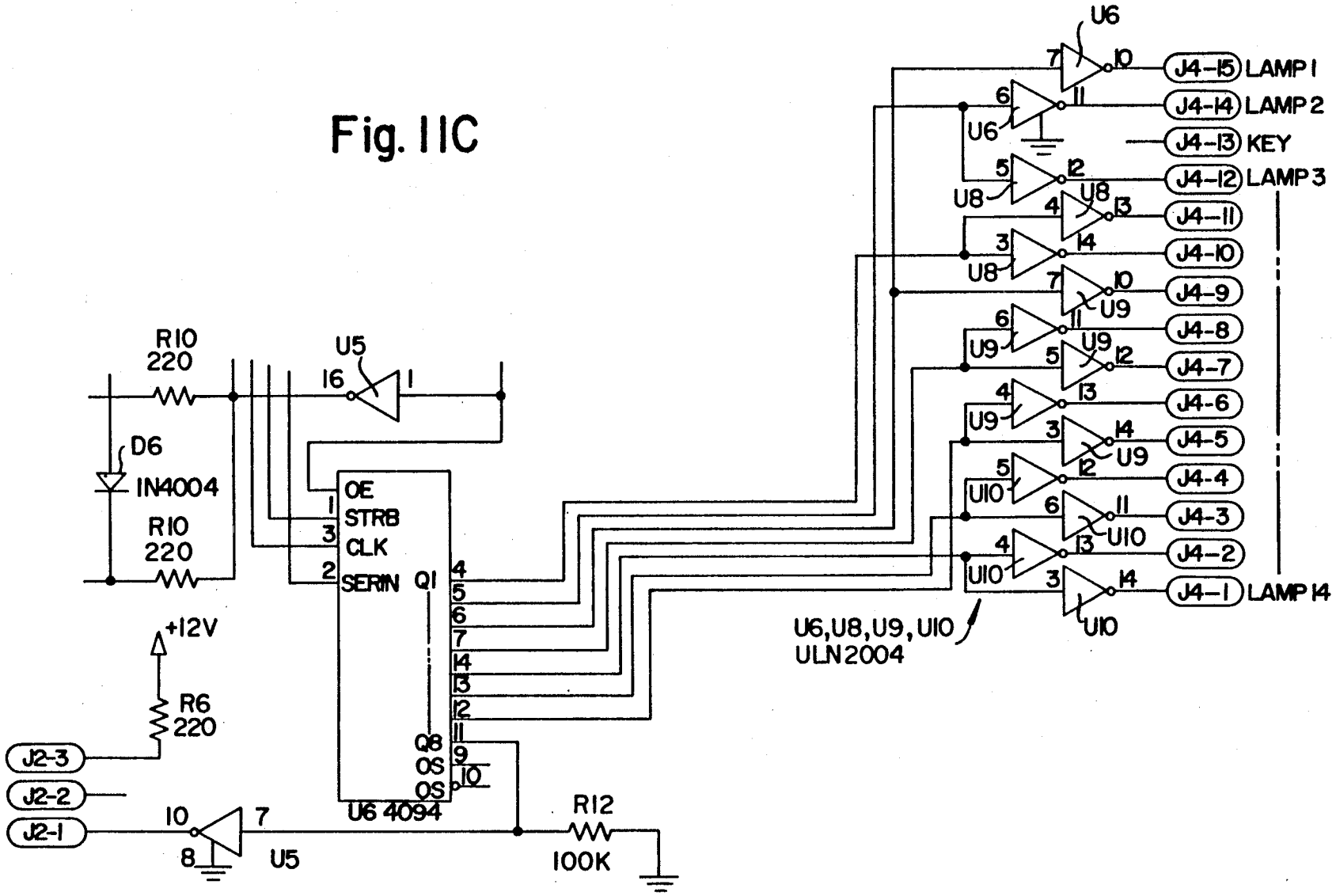
Figure 12A:
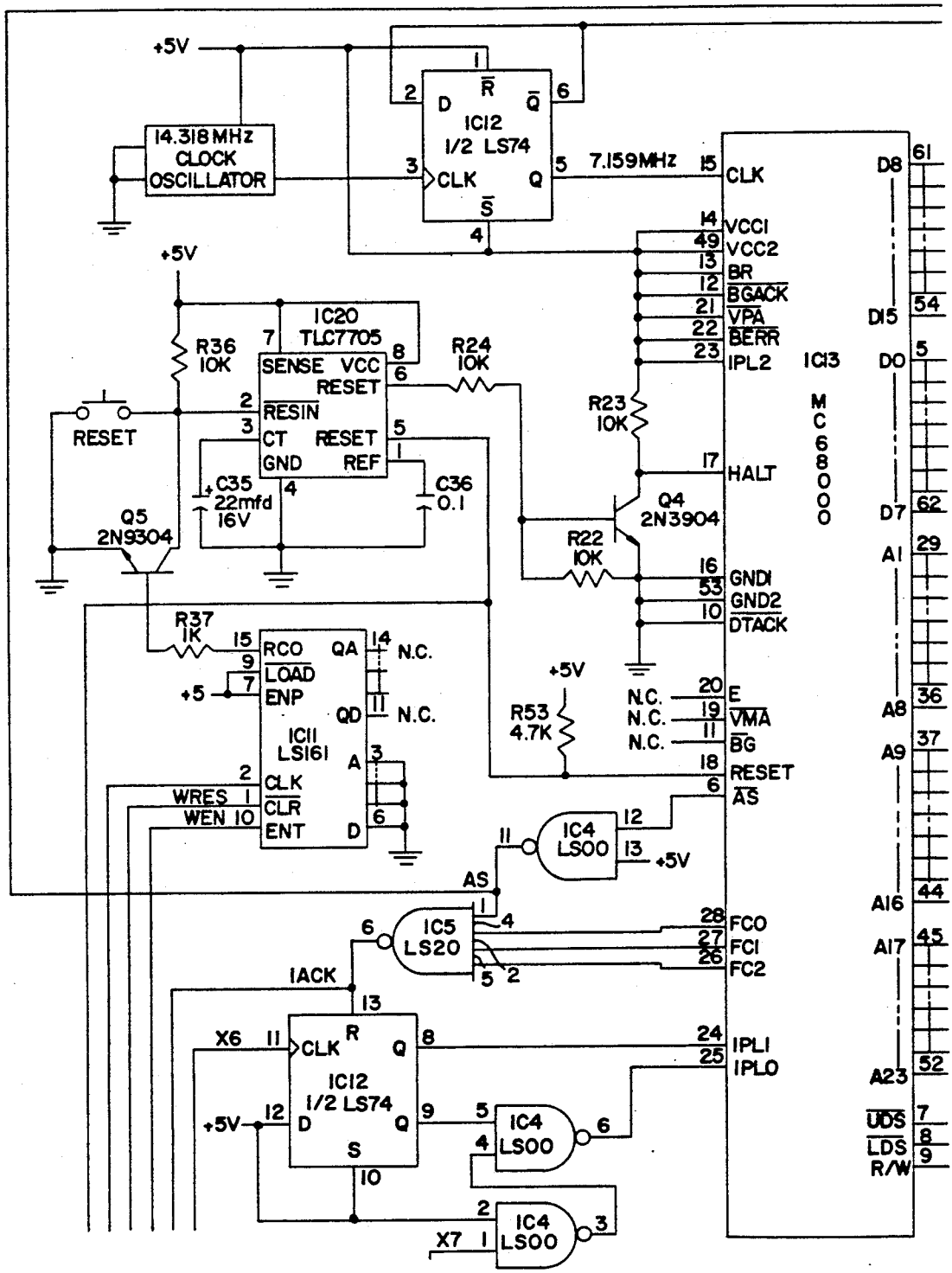
FIG. 12 consisting of FIGS. 12A, FIG. 12B, FIG. 12C, FIG. 12D, FIG. 12E, FIG. 12F, FIG. 12G
Figure 12B:
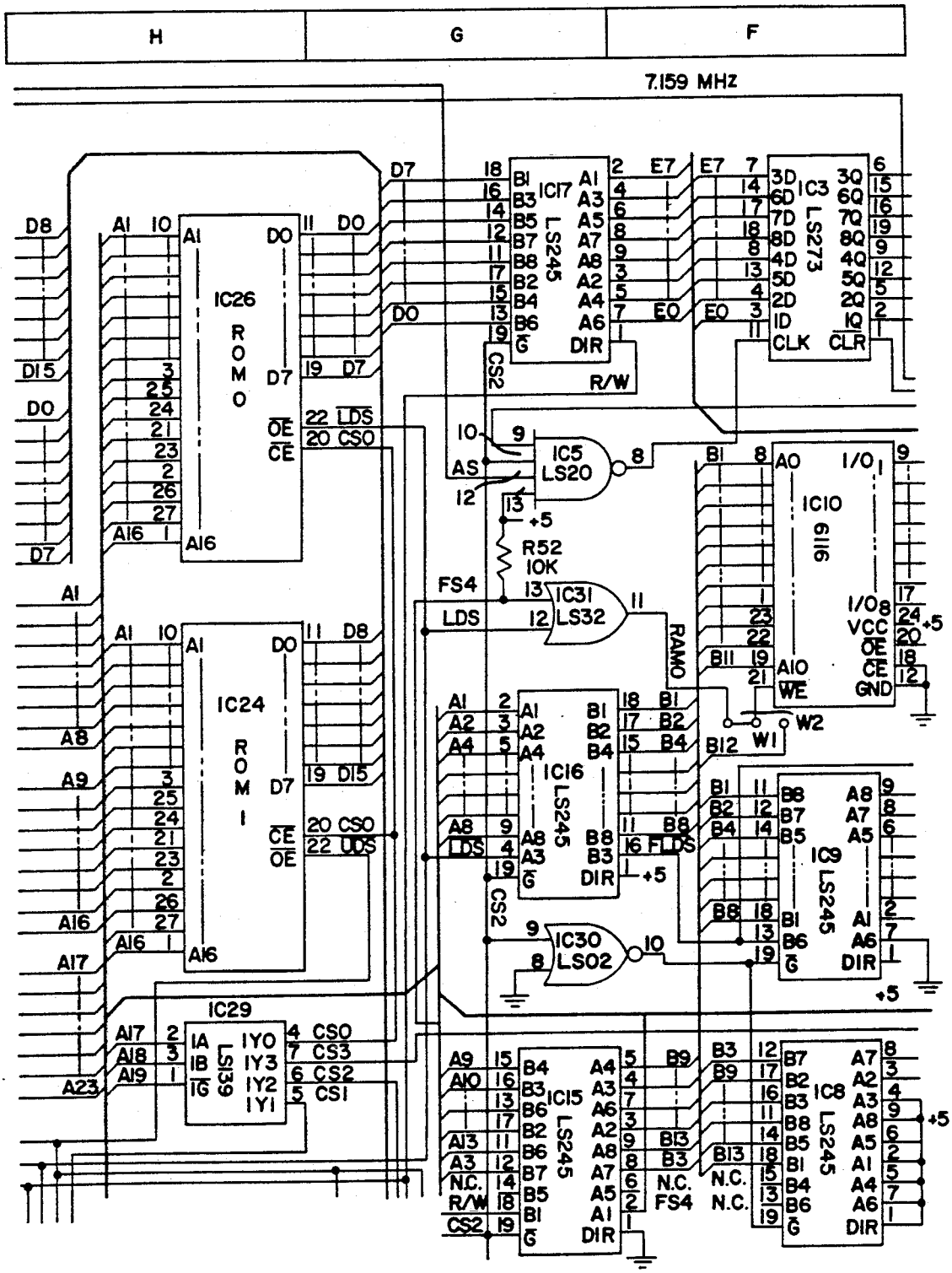
Figure 12C:
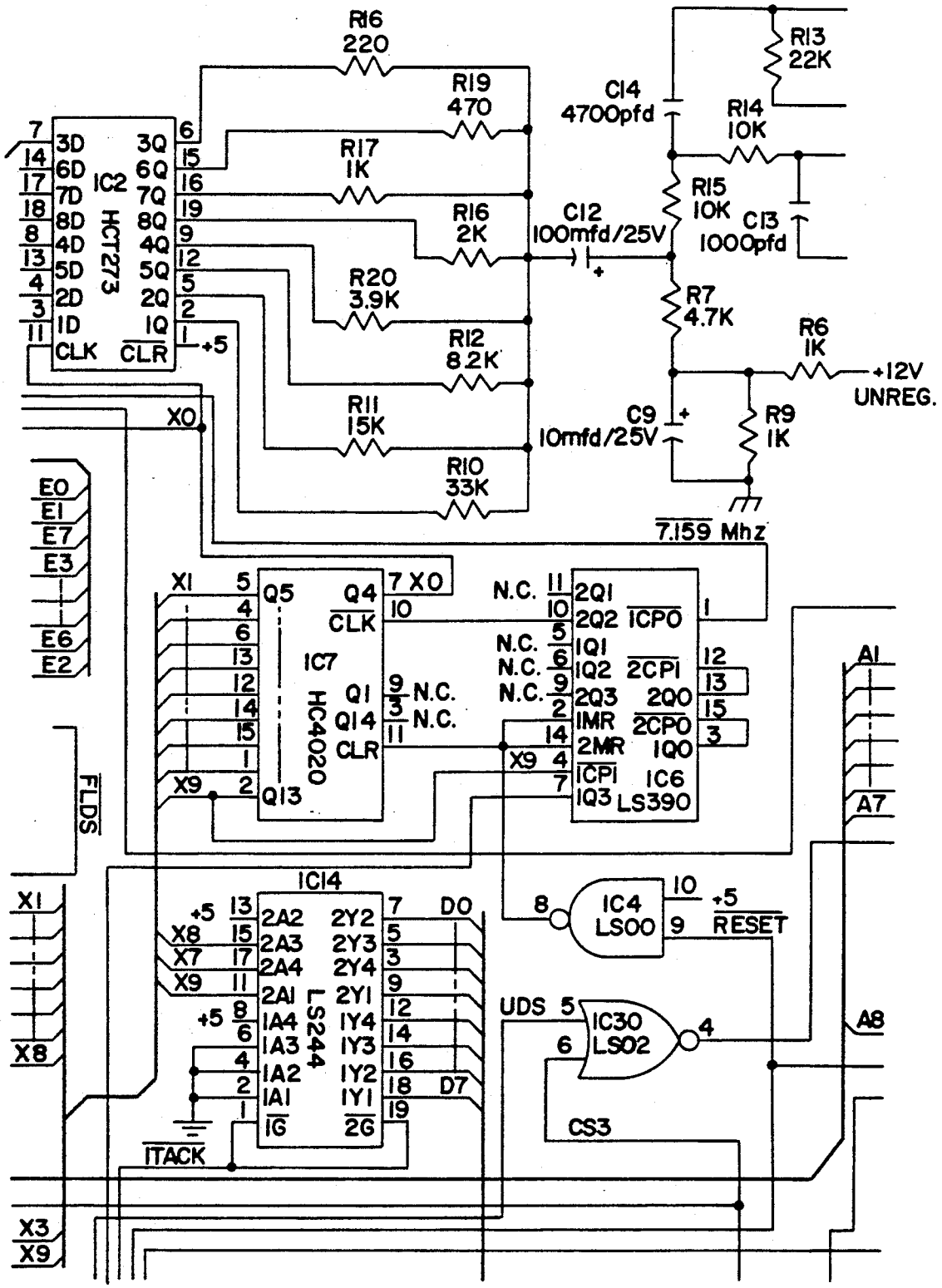
Figure 12:
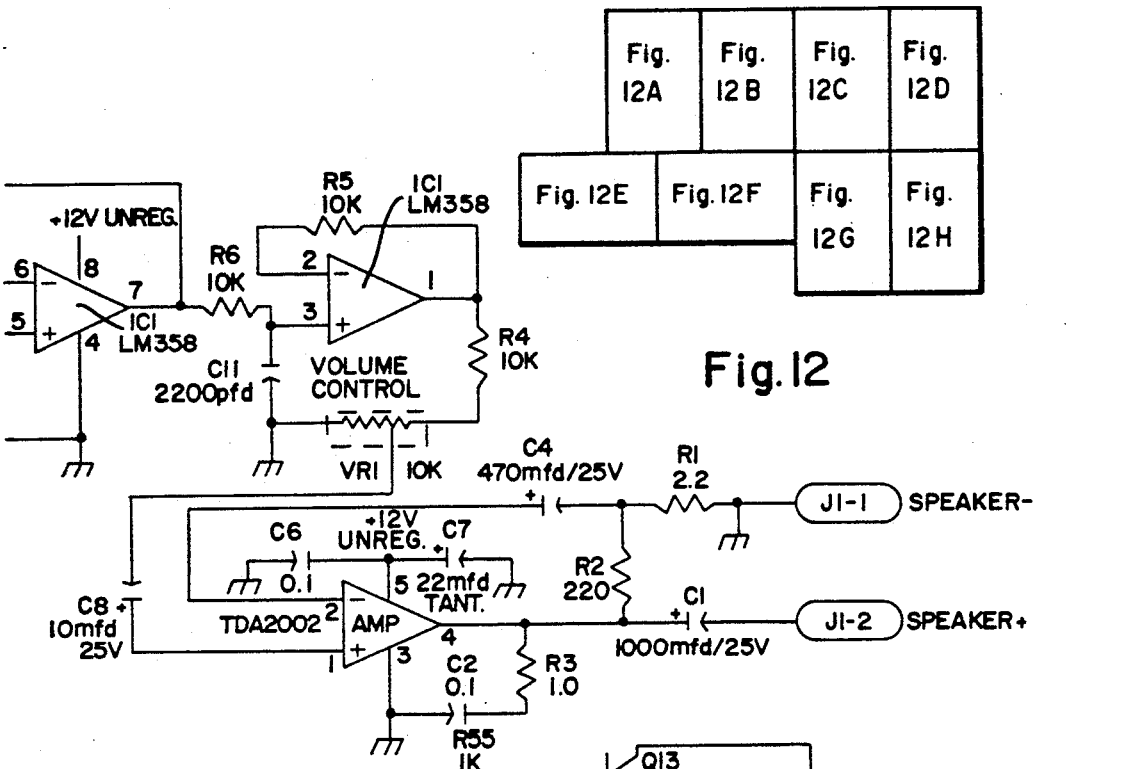
Figure 12D:
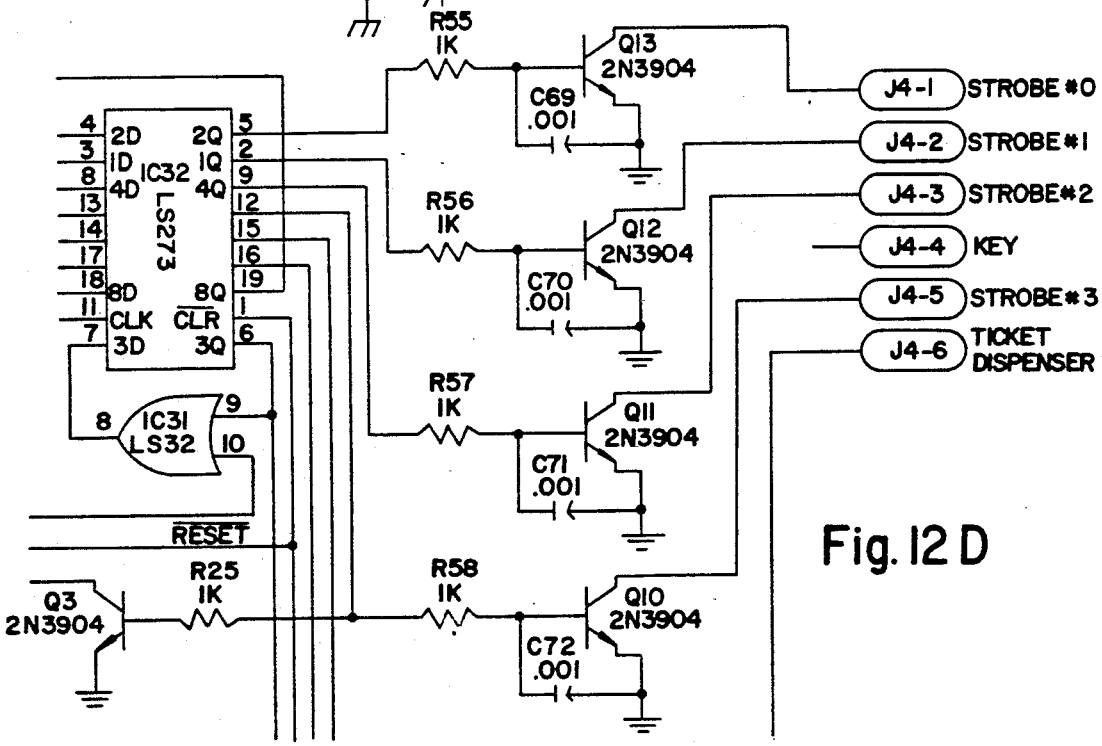
Figure 12E:
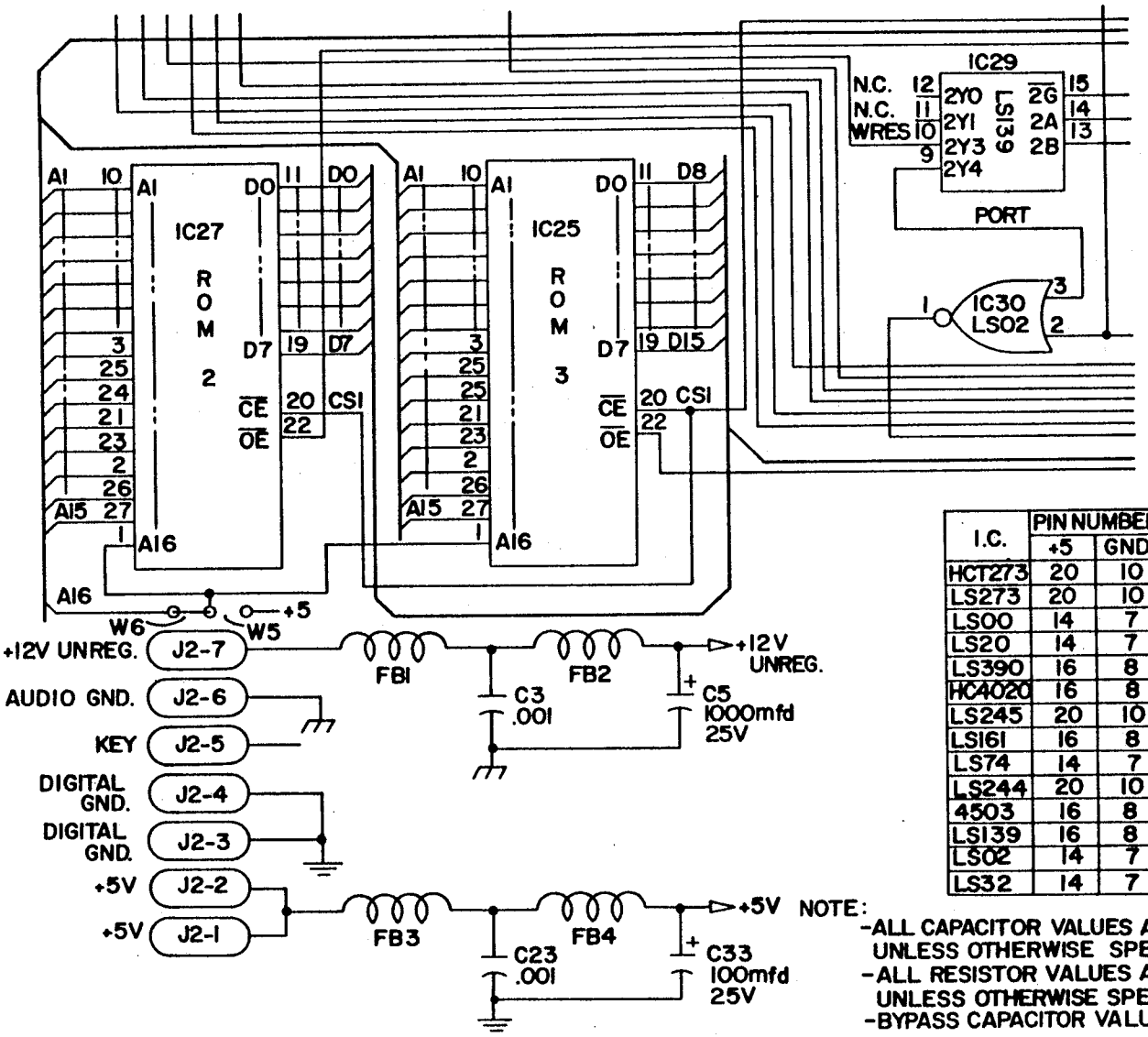
Figure 12F:
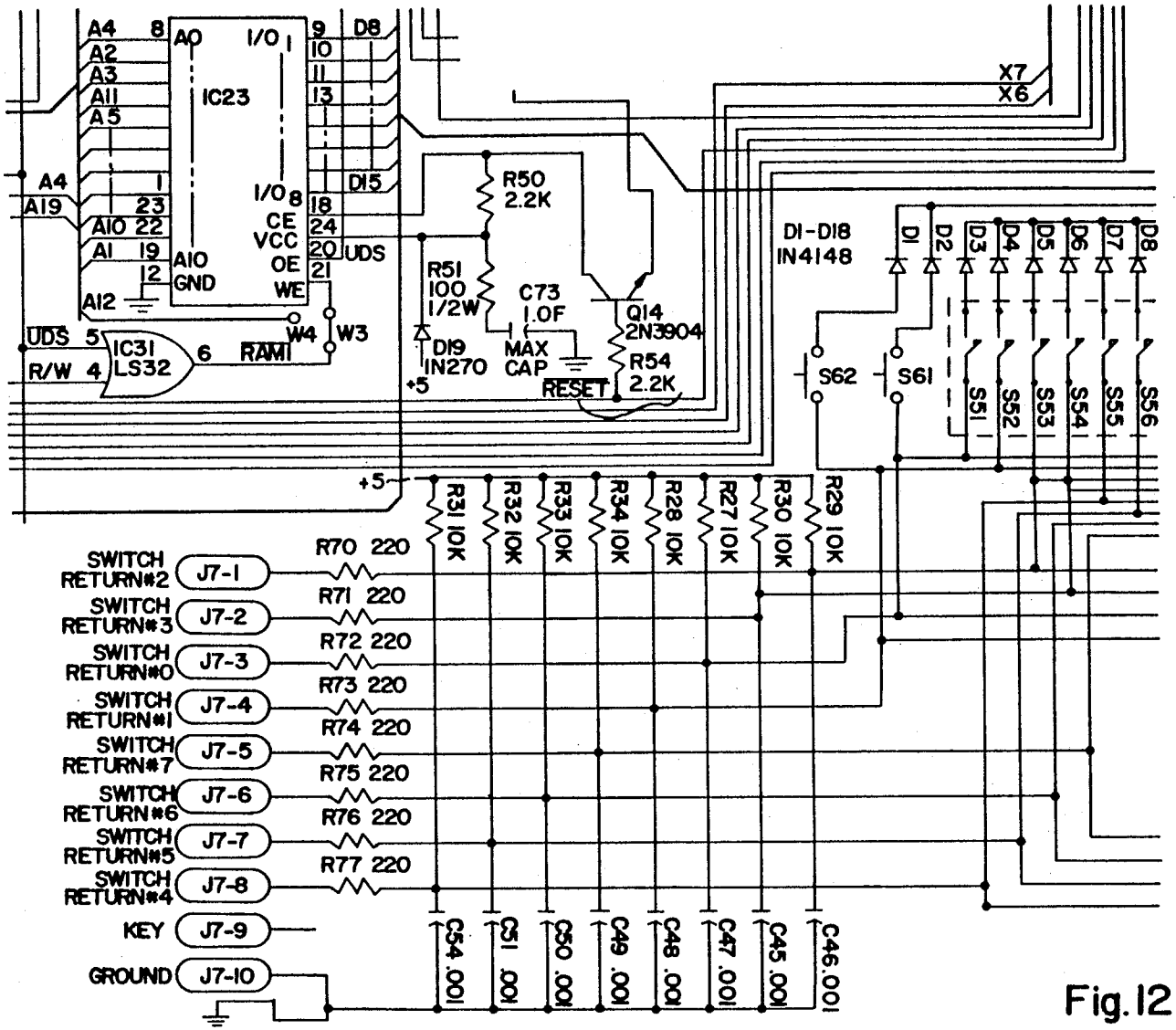
Figure 12G:
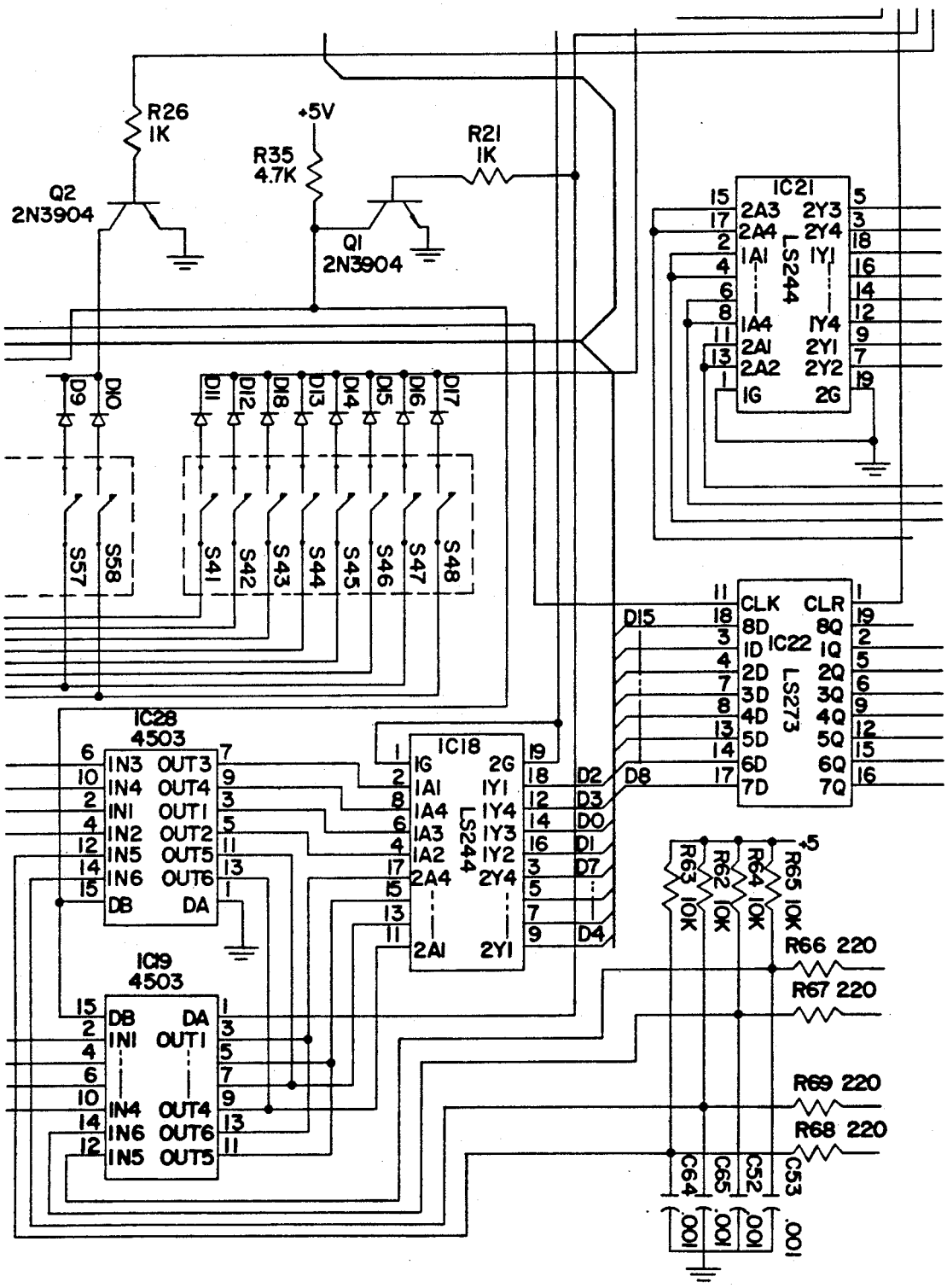
Figure 12H:
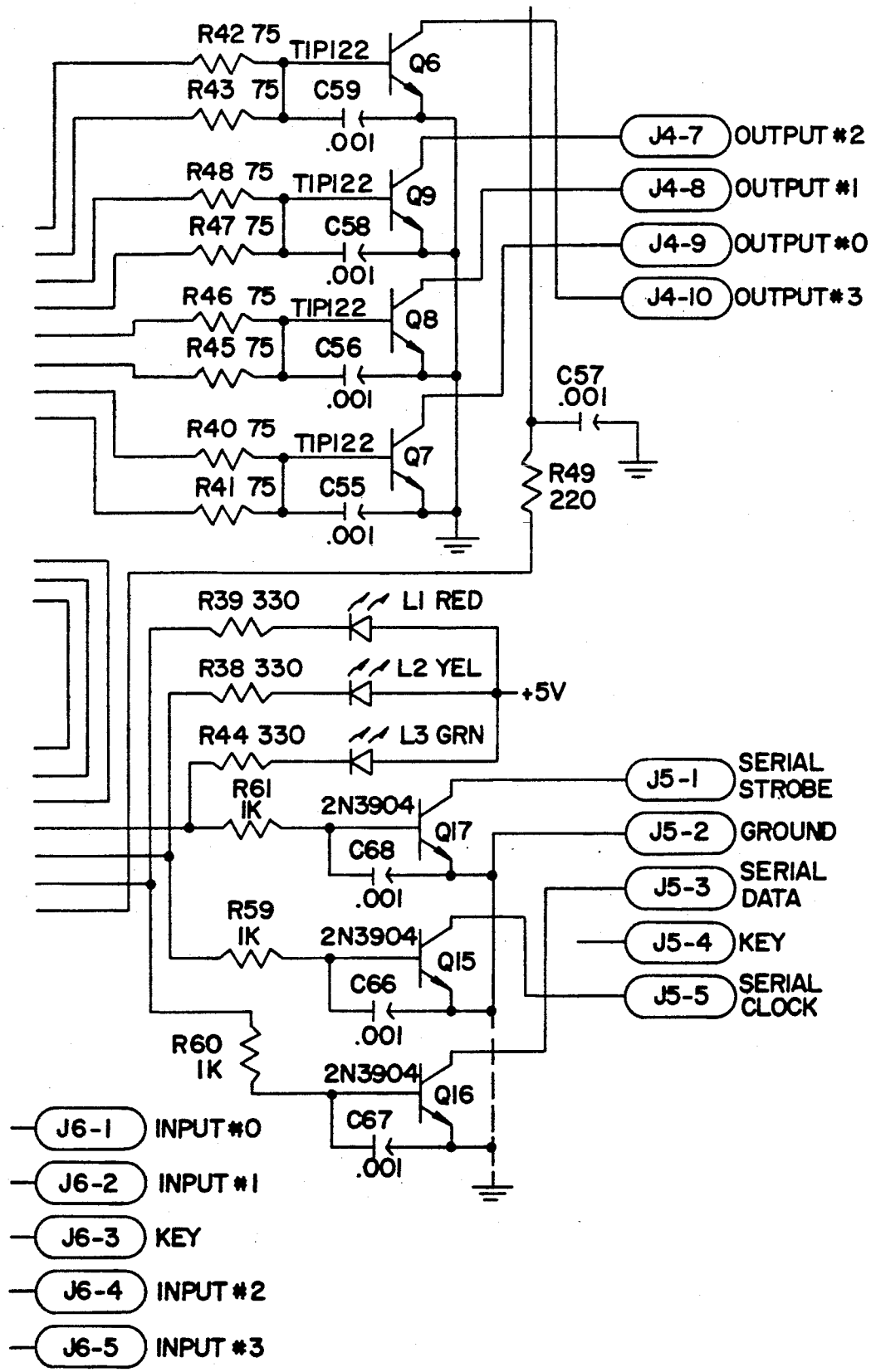

As illustrated in FIG. 4 each of the target pins 48 which are connected to micro-switches such as may be obtained from Cherry or Omron of Japan which are connected by circuitry to the microprocessor. Each of the target pins are pivotally mounted with respect to the housing 10 and are designed to pivot in the direction of arrow 50 (FIG. 3) when hit by a coin 34. Each of the pins 48 include a backing member 52 for contacting the micro-switch which is connected to the microprocessor as is illustrated in FIGS. 10, 11 and 12. Each of the target pins 48 may have a different base 54 and areas which terminate in a target area 56, 58 and 60 of varying widths and areas to correspond with varying degrees of point or prizes value associated with each of the target pins for rewarding a skillful operator who properly directs a coin on its edge through the pivotal coin chute 18 to a particular target pin to receive a reward corresponding to the difficulty of striking the pin based upon the varying point values provided by varying widths of target areas 56, 58 and 60 as illustrated in FIG. 4.

The difficulty in hitting a particular target area 56, 58 and 60 and the skill required to hit that particular target area is in the control of the operator who selects a particular target pin and then pivots the entire pivotal coin chute 18 in housing 10 through pivot 62 provided in housing 10 before inserting a coin 34 into the pivotal coin chute 18. In this manner the operator through a combination of skill in the selection of a particular target pin 48 having a target area 56, 58 and 60 of a predetermined difficulty determines which prizes or the number of tickets 26 that are to be rewarded by successful contact of a particular target area. The substantially flat playing surface 14 in the preferred embodiment is disposed at a slight downward incline as represented by arrow 64 (FIG. 3) to maintain the velocity of the rolling coin toward the target area.

The playing surface 14 further includes a sweeper arm 66 disposed to the rear of the coin guidance chute 44 near the player end of the playing surface 14. The sweeper arm extends across the width of the playing surface 14 and is activated by the computer program of the microprocessor as will be discussed hereinafter in greater detail to remove at predetermined times fallen coins 34 (FIG. 7) from the playing surface 14 to deposit them in a coin collection box 68. The sweeper arm 66 is connected to a plastic or elastomeric belt 70 which in the preferred embodiment is a polyurethane belt disposed between two rollers 72 and 74. The sweeper arm 66 includes a guide 76 and a track 78 for maintaining the position of the sweeper arm as it moves across the playing surface 14 first in the direction to remove coins and then in the other direction as indicated by arrows 80 in FIG. 8 to return the sweeper arm to its normal position as indicated in FIG. 2. The activation of sweeper arm 66 is by an electric motor 82 such as may be obtained from Multiproducts, Inc. connected to a drive box 84 which in combination with motor 82 drives roller 72.

The combination of the belt 70, track 78 and guide 76 are covered with a cover 86 which may include a plurality of lights 88 (FIGS. 1 and 2) which may be activated upon the release of coin 34 from the funnel shaped trough 46 to light sequentially to sequentially track the rolling of the coin or token down the playing surface 14 to the plurality of target pins 48. The release of the coin from the trough 46 may also be utilized to activate voice and sound recordings through the speaker 20 and light up lights in the display to signal the beginning of the game. Thereafter the microprocessor activates the appropriate electrical circuitry to operate the lights in the display including win and strike lights (not shown) in the display once one of the target areas 56–60 is struck by a coin or token.

Figure 9:
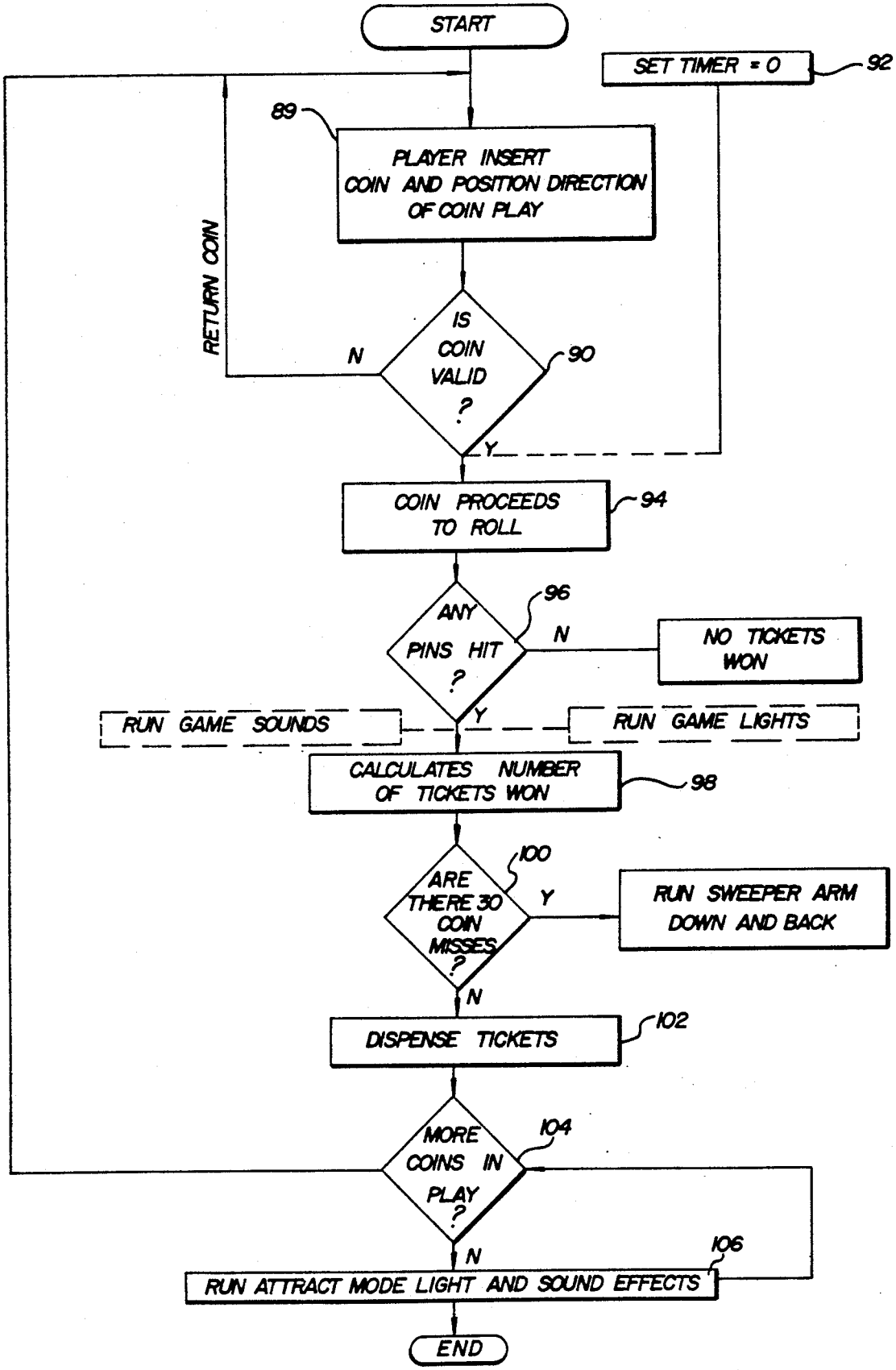
FIG. 9 is a flow chart illustrating one system of operation for the microprocessor controlled coin bowling game in accordance with a preferred embodiment of the invention.

Referring now to FIGS. 9, 10, 11, 12 and the Appendix Item, the microprocessor schematics, power supply and display circuitry together with a computer printout of the program is illustrated for the novel microprocessor controlled coin bowling game. The flow chart of FIG. 9 illustrates a flow chart of the computer program in accordance with the preferred embodiment of the invention.

The game is started by inserting a coin or token as represented by block 89 in FIG. 9. The coin accept and reject mechanism determines whether the coin or token is valid as represented in step 90. If the coin is not valid, the coin is returned to the coin return slot. If the coin is valid, the coin mechanism strobes J7-3 (FIG. 12) of the microprocessor. The game timer as represented at step 92 is set to zero and the microprocessor runs the game start sounds J1-1 and J1-2 and turns on the appropriate frame light J4-1 to J4-10 (FIG. 10). The coin proceeds to roll down the playing surface 14 as indicated in step 94.

The striking of the coin or token against a specific target pin 48 at step 96 activates the appropriate strike light J5-1 to J5-10 (FIG. 10). The striking of one of a particular target pins results in the microprocessor activating J1-1 and J1-2 of the game sound circuitry, runs light effects J6-1 to J6-7 and calculates the number of tickets won as represented by step 98, and plays game sounds and provides an audible indication of the win. Tickets or prizes are advanced by the activation of the ticket dispenser J4-6 of FIG. 12 as represented by step 102.

At a predetermined number of coins missed as represented by step 100 the sweeper arm motor is activated as represented by J3-9 and J3-10 in FIG. 11. The sweeper motor arm is activated through the circuitry represented by U1 4094 FIG. 11. Tickets are dispensed in step 102 and the microprocessor determines at step 104 whether additional coins have been inserted to either return to step 92 or to activate the attract mode sounds and corresponding light effects represented by step 106. The schematics for the microprocessor board for driving the program as illustrated in FIG. 9 is illustrated in FIG. 12 and a complete computer program of the preferred embodiment of the novel amusement game is provided in Appendix Item 1, pages 1–10.

Rock 'N Bowl Copyright 1990 Bromley, Inc.

```
/*
   GAME.C — game code for ROCK N BOWL Novelty game                    APP. ITEM 1

      PJB  3/19/90

*/

#include "rnb.h"
#include "kernal.h"

/*   #define DO_TICKET_TIMEOUT 1   undefined for RNB v1.02 7/23/90 PJB */

#define DO_SWEEPER_TIMEOUT 1
#define QUIET_PLAY         1

struct char_fifo tickets;
struct char_fifo strobes;

#define dispense_tickets(n)   put_q(n,&tickets)
#define strobe(n)             put_q(n,&strobes)

unsigned char game_playing;
int frame;
int coin_timeout;
int frame_timeout;
int odds_index;
int sweeper_run_interval;
int timeouts_since_sweep;
char attract_mode_sounds;
int always_payout_amount;
char disable_sweeper;
char coin_sound_override;
unsigned char made_strike[11];

extern int fl_arg;
extern long time_since_start;

#define COIN_TIMEOUT_SW1  24
#define COIN_TIMEOUT_SW2  25
#define COIN_TIMEOUT_SW3  26

#define FRAME_TIMEOUT_SW1 27
#define FRAME_TIMEOUT_SW2 28
#define FRAME_TIMEOUT_SW3 29

#define ATTRACT_SOUNDS_SWITCH 30

#define SWEEPER_TIME_SW1   32
#define SWEEPER_TIME_SW2   33
#define SWEEPER_TIME_SW3   34
```

Rock 'N Bowl Copyright 1990 Bromley, Inc.

```
      Rock 'N Bowl      Copyright 1990   Bromley, Inc
#define TICKET_PER_PLAY_SWITCH_1 35
#define TICKET_PER_PLAY_SWITCH_2 36

#define COIN_SOUND_OVERRIDE_SWITCH 38
#define SWEEPER_OVERRIDE_SWITCH  39


#define PIN_BOUNCE_TIMEOUT 1*SECONDS


#ifndef TEST_SOFTWARE

int pin_switch_map[] =
  {PIN1,PIN2,PIN3,PIN4,PIN5,PIN6,PIN7,PIN8,PIN9,PIN10};

int pin_timer_map[] =
  {PIN1_TIMER,PIN2_TIMER,PIN3_TIMER,PIN4_TIMER,PIN5_TIMER,
   PIN6_TIMER,PIN7_TIMER,PIN8_TIMER,PIN9_TIMER,PIN10_TIMER};

int coin_timeout_tab[] = {2*SECONDS,2*SECONDS+SECONDS/2,3*SECONDS,
                          3*SECONDS+SECONDS/2,4*SECONDS,4*SECONDS+SECONDS/2,
                          5*SECONDS,6*SECONDS};

int frame_timeout_tab[] = {10,15,20,25,30,35,40,45};

int miss_payout_tab[] = {0,1,2,3};

payout_amounts[4][10] = {
   {100,20,15,15,10,10,10,15,15,50},    /* both odds switches off */
   {50,10,8,8,5,5,5,8,8,25},   /* 1 ON 2 OFF */

   {75,15,10,10,7,7,7,10,10,30},   /* 2 ON 1 OFF */
   {25,5,4,4,3,3,3,4,4,15}    /* both odds switches on  */
  };

/*****************************************************************************
   payout — calculate number of tickets for this pin/frame combination
*****************************************************************************/
payout(frame,pin)
int frame;
int pin;
{
   extern char rnb_jpt[];
   extern char jpf[];
   extern char siren[];
   register int temp;

/*
    1st dispense the correct number of tickets
*/
   if((frame != 5) && (frame != 10))
     dispense_tickets(payout_amounts[odds_index][pin-1]);
   else
     dispense_tickets(2*payout_amounts[odds_index][pin-1]);

       Rock 'N Bowl      Copyright 1990   Bromley, Inc.
/


      Rock 'N Bowl      Copyright 1990   Bromley, Inc.
  now do the light shows, etc for this hit
*/
  temp = time_since_start & 0x3;
  if((frame == 5) || (frame == 10) || (pin == 1)){
    flash_lights(4);
    digitized_sound_off();
    play_digitized_sound(jpf,120,TYPE_COMPRESSED);
    put_digitized_sound_in_q(siren,TYPE_COMPRESSED);
```

```
#ifdef QUIET_PLAY
     play_when_quiet(rnb_jpt);
#else
     play(rnb_jpt);
#endif
     }
   else{
     flash_lights(temp==0 ? 1 : temp);
     }

}

/*****************************************************************************
   get_game_settings -- read the DIPS and determine settable parameters
*****************************************************************************/
get_game_settings()
{
   register int index;

   index = chk_input(COIN_TIMEOUT_SW1) + (chk_input(COIN_TIMEOUT_SW2) * 2)
           +(chk_input(COIN_TIMEOUT_SW3) * 4);
   coin_timeout = coin_timeout_tab[index];

   index = chk_input(FRAME_TIMEOUT_SW1) + (chk_input(FRAME_TIMEOUT_SW2) * 2)
   + (chk_input(FRAME_TIMEOUT_SW3) * 4);
   frame_timeout = frame_timeout_tab[index] * SECONDS;

   sweeper_run_interval = chk_input(SWEEPER_TIME_SW1) + (chk_input(SWEEPER_TIME_SW2) * 2)
                          + (chk_input(SWEEPER_TIME_SW3) * 4);
   sweeper_run_interval *= 10;

   odds_index = chk_input(ODDS_1) + (chk_input(ODDS_2) * 2);

   index = chk_input(TICKET_PER_PLAY_SWITCH_1) + (chk_input(TICKET_PER_PLAY_SWITCH_2) * 2);
   always_payout_amount = miss_payout_tab[index];

   attract_mode_sounds = !chk_input(ATTRACT_SOUNDS_SWITCH);
   disable_sweeper = chk_input(SWEEPER_OVERRIDE_SWITCH);
   coin_sound_override = chk_input(COIN_SOUND_OVERRIDE_SWITCH);
}

/*****************************************************************************
   ticket_task -- does the actual work of dispensing tickets as required
*****************************************************************************/
ticket_task()
{
      Rock 'N Bowl      Copyright 1990   Bromley, Inc.


      Rock 'N Bowl      Copyright 1990   Bromley, Inc.
   int i,count;
   extern unsigned char belll[];

loop:

   count = get_q(&tickets);
   for(i=0;i<count;i++){
      INCREMENT_AUDIT(AUDIT_TICKETS_OUT);
      ticket_dispenser_on();

      if(coin_sound_override)
        play_digitized_sound_if_silent(belll,0,TYPE_COMPRESSED);
      else
        play_digitized_sound(belll,0,TYPE_COMPRESSED);

      set_timer(TICKET_TIMER,TICKET_TIMEOUT);
      while(!chk_sw(TICKET_INPUT) && !timer_expired(TICKET_TIMER))
         yield();
      ticket_dispenser_off();
```

```
#ifdef DO_TICKET_TIMEOUT
      if(timer_expired(TICKET_TIMER))
         error(TICKET_DISP_TIMEOUT_ERR);
#endif
      }
   goto loop;
}

/*************************************************************************
   coin_task -- watches coin switches, starts game when required
*************************************************************************/
coin_task()
{
  extern unsigned char silence[];
  extern unsigned char rnb_snd[];

/*
   wait for dips to stabilize, then initialize the hardware to make sure
   everything is OK, then read and set adjustable params
*/
   play_digitized_sound(rnb_snd,0,TYPE_COMPRESSED);
   flash_lights(1);
   pause(2*SECONDS);

   get_game_settings();
   init_hardware();
   coin_enable(TRUE);

loop:
   if(chk_input(COIN_SWITCH) && !game_playing){
      if(task_active(GAMEOVER_TASK))
        kill(GAMEOVER_TASK);
      play(silence);
      fork(GAME_TASK,game_task);
      }
   pause(1);
       Rock 'N Bowl      Copyright 1990   Bromley, Inc.


}

/*************************************************************************
  pin_switch — check if any pin switch has been closed
*************************************************************************
pin_switch()
{
   register int i;

   for(i=0;i<10;i++)
      if(chk_input(pin_switch_map[i])){
         if(timer_expired(pin_timer_map[i])){
           INCREMENT_AUDIT(i+PIN_AUDIT_OFFSET);
           INCREMENT_AUDIT(AUDIT_TOTAL_PINS_HIT);
           set_timer(pin_timer_map[i],PIN_BOUNCE_TIMEOUT);
           return(i+1);
           }
         }
   return(FALSE);
}


/*************************************************************************
   game_task — controls all actual game play
*************************************************************************
game_task()
{
   int i;
   int coin_frame;
   int coins_active;
   int pin;
```

```
int temp;
extern unsigned char pins1[];
extern unsigned char ball1[];
extern unsigned char mbm[];
extern unsigned char whoops[];
extern unsigned char strike[];
extern unsigned char boing1[];
extern unsigned char boing2[];
extern unsigned char boing3[];

game_playing = TRUE;
frame = coins_active = 0;
all_lights_off();
clear_all_timers();
INCREMENT_AUDIT(AUDIT_TOTAL_GAMES);
for(i=1;i<11;i++)
  made_strike[i] = FALSE;

if(task_active(LIGHT_TASK))
  kill(LIGHT_TASK);
fork(LIGHT_TASK,strobe_lights);


while(TRUE){
    Rock 'N Bowl      Copyright 1990   Bromley, Inc.


  Rock 'N Bowl      Copyright 1990   Bromley, Inc.
if(chk_sw(COIN_SWITCH)){
  frame += 1;
  if(frame == 11){
    frame = 1;
    all_lights_off();
    INCREMENT_AUDIT(AUDIT_TOTAL_GAMES);
    for(i=1;i<11;i++)
      made_strike[i] = FALSE;
    }
  if((frame == 5) || (frame == 10)){
    play_digitized_sound(jpf,0,TYPE_COMPRESSED);
    put_digitized_sound_in_q(ball1,TYPE_COMPRESSED);
    }
  else{
    play_digitized_sound(ball1,0,TYPE_COMPRESSED);
    }
  flash_lights(0);
  restore_lights();

  INCREMENT_AUDIT(AUDIT_TOTAL_COINS);
  if(frame > get_bb_variable(AUDIT_HIGHEST_FRAME))
    put_bb_variable(AUDIT_HIGHEST_FRAME,frame);

  coins_active += 1;
  if(coins_active > get_bb_variable(AUDIT_MAX_SIMUL_COINS))
    put_bb_variable(AUDIT_MAX_SIMUL_COINS,coins_active);

  strobe(1);

  set_timer(GAME_TIMER,frame_timeout);
  set_timer(FRAME_TIMER,coin_timeout);
  }

if(timer_expired(GAME_TIMER)){
  sweep_alley(TRUE);
  fork(GAMEOVER_TASK,gameover_task);
  game_playing = FALSE;
  suicide();
  }
```

```
if(coins_active){
  if((pin = pin_switch())){
    temp = time_since_start & 0xf;

    if(temp == 10 || temp == 2 || temp == 6)
      play_digitized_sound(strike,0,TYPE_COMPRESSED);
    else
      play_digitized_sound(pins1,0,TYPE_COMPRESSED);

    coin_frame = (frame-coins_active+1) % 11;
    payout(coin_frame,pin);
    made_strike[coin_frame] = TRUE;
    coins_active -= 1;
    }
  else if(timer_expired(FRAME_TIMER)){
  Rock 'N Bowl      Copyright 1990   Bromley, Inc.
```

Rock 'N Bowl  Copyright 1990  Bromley, Inc.

```
        if(always_payout_amount)          /* if option set, reward the loser */
          dispense_tickets(always_payout_amount);

        temp = time_since_start & 0xf;
        if(temp == 2 || temp == 10)
          play_digitized_sound(mbm,0,TYPE_COMPRESSED);
        else if(temp == 5 || temp == 12)
          play_digitized_sound(whoops,0,TYPE_COMPRESSED);
        else if(temp == 0 || temp == 8)
          play_digitized_sound(boing1,0,TYPE_COMPRESSED);
        else if(temp == 1 || temp == 11)
          play_digitized_sound(boing2,0,TYPE_COMPRESSED);
        else
          play_digitized_sound(boing3,0,TYPE_COMPRESSED);

        INCREMENT_AUDIT(AUDIT_TOTAL_TIMEOUTS);
        sweep_alley(FALSE);
        }
      }
    pause(1);
    }

}
/*****************************************************************************
   sweep_alley — coin timeout, sweep it up
*****************************************************************************/
sweep_alley(runit)
int runit;
{
/*  extern unsigned char sweeping_alley[]; */

  timeouts_since_sweep += 1;
  if((sweeper_run_interval && (timeouts_since_sweep >= sweeper_run_interval)) ||
      (!sweeper_run_interval && runit)){
    run_sweeper();
    timeouts_since_sweep = 0;
    clr_switches();
    }

}
/*****************************************************************************
  gameover_task — handle attract mode stuff
*****************************************************************************/
gameover_task()
{
   extern unsigned char rnb_music[];
   extern unsigned char rnb_snd[];
#ifdef TOTALLY_RADICAL
   extern unsigned char tr[];
#endif
```

```
 register int i,j;
 extern unsigned char *digit_sound_ptr;

 set_timer(ATTRACT_MODE_TIMER_1,30*SECONDS);
     Rock 'N Bowl      Copyright 1990   Bromley, Inc.
 set
       _timer(ATTRACT_!   #(TIMER_2,50*SECONDS);
        Rock 'N Bowl      Copyright 1990   Bromley, Inc.

loop:
   all_lights_off();
   pause(5*SECONDS);
   strobe(13);

   if(attract_mode_sounds && timer_expired(ATTRACT_MODE_TIMER_1)){
     set_timer(ATTRACT_MODE_TIMER_1,65*SECONDS);
     play_digitized_sound(rnb_snd,0,TYPE_COMPRESSED);
     while(digit_sound_ptr)
       yield();
     pause(20);
     play(rnb_music);
     }

   for(j=0;j<5;j++){

     for(i=1;i<=10;i++){
        frame_light(i,ON);
        pause(3);
        }

     for(i=10;i>=0;i--){
        frame_light(i,OFF);
        pause(3);
        }

     for(i=1;i<=10;i++){
       strike_light(i,ON);
       pause(3);
       }

     for(i=10;i>=0;i--){
       strike_light(i,OFF);
       pause(3);
       }

     }
#ifdef TOTALLY_RADICAL
   if(attract_mode_sounds && timer_expired(ATTRACT_MODE_TIMER_2)){
     set_timer(ATTRACT_MODE_TIMER_2,65*SECONDS);
     play_digitized_sound_if_silent(tr,0,TYPE_COMPRESSED);
     }
#endif
   goto loop;
}
#endif  /* TEST SOFTWARE */
/*****************************************************************************
  run_sweeper — move the coin sweeper down and back to get any coins
*****************************************************************************/
run_sweeper()
{

/*
   if master  sweeper disable switch is set, dont do anything
       Rock 'N Bowl      Copyright 1990   Bromley,, Inc.
*/
```

Rock 'N Bowl Copyright 1990 Bromley, Inc.

```
   if(disable_sweeper)
      return;

/*
   make sure no coins during sweep
*/
   coin_enable(FALSE);
   pause(coin_timeout);
/*
    turn on outward bound sweeper
*/
   sweeper_out();

   set_timer(SWEEPER_TIMER,SWEEPER_TIMEOUT);
/*
   make sure it gets off of the HOME SWITCH
*/
   while(chk_input(SWEEPER_HOME) && !timer_expired(SWEEPER_TIMER))
      yield();

#ifdef DO_SWEEPER_TIMEOUT
   if(timer_expired(SWEEPER_TIMER)){
      sweeper_off();
      error(SWEEPER_TIMEOUT_ERR);
      }
#endif

/*
    now wait until it hits the away switch
*/
   while(!chk_input(SWEEPER_AWAY) && !timer_expired(SWEEPER_TIMER))
      yield();
   sweeper_off();
#ifdef DO_SWEEPER_TIMEOUT
   if(timer_expired(SWEEPER_TIMER))
      error(SWEEPER_TIMEOUT_ERR);
#endif
/*
   start it coming back
*/
   sweeper_back();

   set_timer(SWEEPER_TIMER,SWEEPER_TIMEOUT);
   while(chk_input(SWEEPER_AWAY) && !timer_expired(SWEEPER_TIMER))
      yield();
#ifdef DO_SWEEPER_TIMEOUT
   if(timer_expired(SWEEPER_TIMER)){
      sweeper_off();
      error(SWEEPER_TIMEOUT_ERR);
      }
#endif

   while(!chk_input(SWEEPER_HOME) && !timer_expired(SWEEPER_TIMER))
      yield();
   sweeper_off();
```

Rock 'N Bowl Copyright 1990 Bromley, Inc.

```
#ifdef D
```

Rock 'N Bowl Copyright 1990 Bromley, Inc.

```
   if(timer_expired(SWEEPER_TIMER))
      error(SWEEPER_TIMEOUT_ERR);
#endif

   INCREMENT_AUDIT(AUDIT_TOTAL_SWEEPS);
   coin_enable(TRUE);
}
/*****************************************************************************
 all_lights_off — turn off all strike and frame lights
*****************************************************************************/
```

```
all_lights_off()
{
   register int i;

   for(i=1;i<=10;i++){
     strike_light(i,OFF);
     frame_light(i,OFF);
     }
}
/*****************************************************************************
   restore_lights -- restore strike and frame lights to proper state after
                     flashing
*****************************************************************************/
restore_lights()
{
   register int i;

   all_lights_off();
   for(i=1;i<=frame;i++){
     frame_light(i,ON);
     if(made_strike[i])
       strike_light(i,ON);
     }
}
```

Rock 'N Bowl Copyright 1990 Bromley, Inc.

As will be understood by those skilled in the art the invention may be implemented and modified in a great variety of ways to include additional target pins and include embodiments of providing for multiple and competing players while utilizing the basic aspects and advantages of the invention. For example different colored coins or tokens could be utilized where two or more players compete against each other and modifications could be made in the computer program to manually allow for the removal of fallen coins or based upon a predetermined number of coins that have not contacted the target pins.

The game may be further modified to substitute the pivotal coin chute with a coin chute that may be axially positioned with respect to the player end of the housing and the computer program modified to totalize the number of prizes or reward tickets where multiple players or multiple coins are consecutively played. The game may also include the provision for purposely or permanently having obstacles disposed on the playing surface. These and other modifications may be made in the computer program and related circuitry along with the modifications in the area of the base of the pin to increase and decrease the difficulty and skill required to strike a particular pin prior to obtaining tickets or prizes for the successful completion of the game. It will be appreciated the invention is consequently susceptible to various modifications which can be made within the spirit and scope of the invention as defined in the following claims.

What is claimed is:

1. A rolling coin or token target simulated bowling game comprising:

(a) a housing having a substantially flat playing surface having a first end and a second end and a transparent cover for covering said substantially flat playing surface;

(b) a pivotal coin or token chute for depositing a rolling coin or token on its edge on said substantially flat playing surface intermediate said first end and said second end;

(c) at least one target for said rolling coin or token disposed intermediate said first end and said second end of said substantially flat playing surface;

(d) a sweeper arm for removing fallen coins or tokens from said substantially flat playing surface disposed near said first end of said substantially flat playing surface;

(e) means for signalling a successful strike of said target by said rolling coin or token; and (f) microprocessor means for activating said means for signalling a successful strike of said target and for selectively activating said sweeper arm upon predetermined conditions.

2. The rolling coin or target simulated bowling game of claim 1 wherein said substantially flat playing surface is inclined to assist in the rolling of said rolling coin or token to said second end of said substantially flat playing surface.

3. The rolling coin or target simulated bowling game of claim 1 further comprising a coin accept and reject mechanism.

4. The rolling coin or target simulated bowling game of claim 3 wherein said pivotal coin or token chute includes said coin accept and reject mechanism and said pivotal coin or token chute is pivotally disposed in said housing.

5. The rolling coin or target simulated bowling game of claim 1 wherein said at least one target is pivotally mounted to said housing and is connected through switches to said microprocessor.

6. The rolling coin or target simulated bowling game of claim 5 further comprising a plurality of targets pivotally mounted to said housing.

7. The rolling coin or target simulated bowling game of claim 6 wherein a base of each of said targets is of a different target area having a point value corresponding to said target area.

8. The rolling coin or target simulated bowling game of claim 7 wherein said means for signalling is an LED or illuminated display having different LED light displays corresponding to said different point value of each of said targets.

9. The rolling coin or target simulated bowling game of claim 8 further comprising a second means for signalling wherein said second means for signalling is an audible speaker operatively connected to said microprocessor.

10. An amusement target simulated bowling game comprising:

(a) an enclosed platform having a player end and a target end;

(b) a plurality of targets and associated sensors disposed at said target end of said enclosed platform;

(c) a coin or token chute having an outlet for depositing a rolling coin or token on its edge on said platform near the player end of said enclosed platform;

(d) a selectively activatable sweeper arm disposed intermediate said pivotal coin or token chute outlet and said target end of said enclosed platform for removing fallen coins or tokens from said enclosed platform;

(e) a display means for signalling a successful strike of said plurality of targets by said rolling coin or token for each of said associated sensors; and (f) microprocessor means for activating said means for signalling said successful strike of said plurality of targets.

11. The amusement target simulated bowling game of claim 10 wherein said enclosed platform is inclined to assist in the rolling of said coin or token toward said target end.

12. The amusement target simulated bowling game of claim 10 further comprising a coin accept and reject mechanism disposed in said pivotal coin or token chute and operatively connected to said microprocessor means.

13. The amusement target simulated bowling game of claim 10 wherein said plurality of targets are pivotally mounted with respect to said enclosed platform.

14. The amusement target simulated bowling game of claim 10 wherein a base of each of said plurality of targets is of a different width and has a correspondingly different point value and wherein each of said targets is operatively connected to said microprocessor.

15. The amusement target simulated bowling game of claim 14 further comprising a means for dispensing rewards based on said different point value of said plurality of targets operatively connected to said microprocessor.

16. A coin or token simulated bowling game comprising:

(a) a housing having a substantially flat playing surface with a player end and a target end and a transparent cover for covering said substantially flat playing surface;

(b) a pivotal coin or token chute for depositing a rolling coin or token on its edge on said substantially flat playing surface; near the player end;

(c) a plurality of targets and associated sensors disposed at said target end of said substantially flat playing surface;

(d) a sweeper arm for removing fallen coins or tokens from said substantially flat playing surface;

(e) means for signalling a successful strike of said target by said rolling coin or token;

(f) means for dispensing rewards based upon a successful strike of one of said plurality of targets; and (g) microprocessor means for selectively activating said sweeper arm upon predetermined conditions.

17. The coin or token simulated bowling game of claim 16 wherein said substantially flat playing surface is inclined.

18. The coin or token simulated bowling game of claim 17 further comprising a coin accept and reject mechanism operatively connected to said microprocessor means.

19. The coin or token simulated bowling game of claim 17 wherein said plurality of targets are pivotally mounted in said housing.

20. The coin or token simulated bowling game of claim 19 wherein the base of said plurality of targets have one or more different widths.

* * * * *